US005905223A

United States Patent [19]

Goldstein

[11] Patent Number: 5,905,223

[45] Date of Patent: May 18, 1999

[54] METHOD AND APPARATUS FOR AUTOMATIC VARIABLE ARTICULATION AND TIMBRE ASSIGNMENT FOR AN ELECTRONIC MUSICAL INSTRUMENT

[76] Inventor: Mark Goldstein, 1075A Pine St., Menlo Park, Calif. 94025

[21] Appl. No.: 08/968,655

[22] Filed: Nov. 12, 1997

Related U.S. Application Data

[60] Provisional application No. 60/030,751, Nov. 12, 1996.

[51] Int. Cl.[6] ..... G10H 1/26; G10H 1/38

[52] U.S. Cl. ..... 84/649; 84/650; 84/DIG. 22

[58] Field of Search ..... 84/609–620, 622–638, 84/649–669, DIG. 22

[56] References Cited

U.S. PATENT DOCUMENTS

| | | | |
|---|---|---|---|
| 4,332,183 | 6/1982 | Deutsch . | |
| 4,424,731 | 1/1984 | Howell . | |
| 4,602,544 | 7/1986 | Yamada et al. | 84/609 |
| 5,088,380 | 2/1992 | Minamita | 84/DIG. 22 |
| 5,142,960 | 9/1992 | Iwase et al. . | |
| 5,218,158 | 6/1993 | Kimura | 84/653 X |
| 5,260,510 | 11/1993 | Shibukawa | 84/DIG. 22 |
| 5,365,019 | 11/1994 | Usa . | |
| 5,539,146 | 7/1996 | Tohgi | 84/650 |
| 5,596,160 | 1/1997 | Aoki | 84/653 |
| 5,663,517 | 9/1997 | Oppenheim | 84/649 |
| 5,705,761 | 1/1998 | Minamitaka | 84/DIG. 22 |

OTHER PUBLICATIONS

Opcode Systems, Inc., "MIDI Reference Manual for Vision and Studio Vision Pro," second edition, © 1995, pp. 75–79.

"malletKAT PRO With Sounds Manual," pp. 22–23.

Kurzweil Music Systems, "K2500 Performance Guide," © 1996, pp. Jun. 25–Jun. 26.

*Primary Examiner*—Stanley J. Witkowski

[57] ABSTRACT

A signal processor acts upon a stream of incoming musical performance data including note-on signals and outputs a stream of musical performance data including note-on and note-off signals. The incoming performance data is dispatched to a multiplicity of output channels depending on the time interval between successive incoming note-on data. Notes played in very rapid succession are identified as chords and are performed with identical musical parameters such as duration and instrumental timbre. Notes played in slow succession are identified as polyphonic and are performed with the same instrumental timbre. Notes played at an intermediate speed are identified as melodic and are performed with the same instrumental timbre and a variable staccato or legato effect. A variable legato effect is achieved by controlling the overlap of successive pairs of notes, adjusting the release of the first note with respect to the onset of the second note as a function of the time interval between their onsets, and limiting the number of notes that can sound simultaneously. A variable staccato effect is achieved by controlling the duration of each note as a function of the time interval between the note and its predecessor, and limiting the number of notes that can sound simultaneously.

36 Claims, 19 Drawing Sheets

METHOD AND APPARATUS FOR AUTOMATIC VARIABLE ARTICULATION AND TIMBRE ASSIGNMENT FOR AN ELECTRONIC MUSICAL INSTRUMENT

CROSS REFERENCE TO RELATED APPLICATIONS

This application claims priority from U.S. Provisional Patent Application Serial No. 60/030,751, entitled "A Musical Performance Data Signal Processor", filed Nov. 12, 1996. The disclosure of that provisional patent application is incorporated herein by reference in its entirety.

BACKGROUND OF THE INVENTION

1. Field of the Invention

The present invention relates broadly to the field of electronic musical instruments, electronic tone generators, and electronic musical controllers. In particular, the present invention relates to a method and apparatus for controlling expressive musical articulation by controlling the duration, overlap, and timbre assignment of successive tones as a function of playing speed.

2. Description of the Related Art

Electronic musical instruments comprise two distinct systems: a tone generator and a controlling interface (controller). The two systems can be embodied in a single device or as two entities that are interconnected. A controller transduces the physical gestures of the performer and sends performance data to one or many tone generators. At a minimum, the performance data includes a pitch and a note-on signal, with optional additional data representing other musical parameters such as velocity. Some controllers sense and transmit note-off data. Typical controllers are a piano-like keyboard, an array of drum pads, or a keyed wind instrument. Another type of controller is a sequencer, which is a program that stores performance data (either recorded from another controller or entered by hand) and replays the data automatically. Further, a controller can be a computer that computes performance data and transmits the performance data over a data transmission line (e.g., a dedicated data transmission line, a data transmission line within a network system, or the Internet) to a tone generator.

Traditionally, a performer controls articulation by varying musical attributes relating to the perceived "connectedness" of a sequence of notes. There are two main ways to control this effect. One method is to control the time when notes begin and end, thereby controlling the duration of each note and the degree of overlap or detachment among successive notes. Another method is to vary the shape of the amplitude envelope of a note, particularly the speed of the attack (ramp-up in volume from silence or the previous note upon a new note-on action) and release (ramp-down to silence upon note-off action).

One attribute of articulation is the degree of overlap between successive tones. A continuum ranging between "legato" and "staccato" can be used to characterize the articulation of tones. Legato is characterized by slow attack and perceivable overlap between successive tones. Staccato is characterized by fast attack and an interval of silence between tones.

The ability of a performer to control legato/staccato depends on the particular capabilities of the tone generator and controller combination employed. In particular, the degree of legato overlap effect cannot be controlled unless the player can manipulate the controller so as to send separate note-on and note-off signals to the tone generator and the tone generator has the ability to sustain a tone indefinitely and to produce many tones simultaneously.

Continuous controllers, like piano or organ keyboards transmit note-on messages on key depress and note-off on key release. This permits great flexibility in articulation, but can also work to the disadvantage of some players, who may have difficulty performing fast passages where notes "smear" because the keys are not released quickly enough.

Percussive controllers, such as drum pads/triggers or marimba-like arrays of pads respond only to the initial stroke and note duration is controlled indirectly by automatically sending a note-off after some time interval has elapsed. The interval is either fixed or velocity-sensitive (i.e., the duration of the note is a function of the speed at which the drumstick strikes the pad), and is determined at the time of initial gesture and unchangeable thereafter. Fast musical passages can result in blurred sound where many notes of fixed duration overlap.

In current practice, it is common to achieve a legato effect by controlling the attack and decay rates of the amplitude envelope, or by connecting notes in a monophonic fashion, allowing only one tone to sound at a time.

Many continuous and percussive controllers can measure the velocity of the initiating note-on gesture (speed of key-down or mallet stroke, puff of air) and the tone generator can use this data to control rate of attack. Some keyboard controllers can sense the speed of note release and use this information to control release rate. In both cases, the effect is determined at the time of the initiating gesture and applies only to the note associated with that gesture.

The duration of a tone depends on the player's ability to control the moment of note-off (i.e., when the release segment of the envelope begins) and is limited by the affordance of the particular controller being used. In particular, keyboard-like controllers send a note-off signal upon key release, and percussive controllers predetermine note duration at the time of note-on.

Current practice either imposes no constraints on the number of notes with legato envelopes that can sound simultaneously or limits legato to strictly monophonic mode where one tone sounds at a time. When a legato passage is played it is useful to allow only two notes to be sounding at the same time in order to have some amount of overlap while avoiding a blurred effect. The amount of overlap should be adjusted to account for the speed of consecutive notes in a musical passage.

When an electronic instrument allows variable articulative control over envelope and duration, it is always on a note-by-note basis. This can be a problem when a group of notes is performed together in a chord. Individual notes may have different envelopes resulting in an unpleasant balance, or the duration of notes may differ so that the chord is released in a ragged way, each note at a different time.

The Studio Vision sequencer program from Opcode has a legato mode operation that can be applied to a selected range of notes in a sequence. This program will change the duration of each selected note so that it extends a given percentage of the way to the next note. This feature is an editing operation that must be applied to a recorded sequence out of real time; it cannot be used while actually playing.

The Kurzweil K2500 tone generator has a "Legato Play" mode. In this mode a note will play the attack segment of its amplitude envelope only when all other notes have been released. The K2500 also has a legato switch which causes the instrument to behave in a monophonic fashion: whenever a new note is begun, the previously sounding note is immediately terminated.

The "malletKAT" is a MIDI (musical instrument digital interface) controller that resembles a xylophone. It has a mono mode overlap feature which provides a fixed overlap interval between successive notes; when a new note is started the previous note is terminated after the fixed interval has elapsed. The overlap interval does not change and the feature is available only when the controller is in monophonic mode; thus, chordal or polyphonic performance of many simultaneous tones is impossible.

U.S. Pat. No. 5,142,960 describes a keyboard instrument that produces a legato-type envelope depending on a predetermined playing style and instrument timbre. The legato effect is strictly monophonic; it is produced when a new note-on is received and another note its still sounding. The release of the old note and attack of the new note are forced to be coincident and shaped by a predetermined amplitude envelope with relatively small attack for the new note. No overlapping of the two notes occurs.

U.S. Pat. No. 4,332,183 describes a keyboard instrument which distinguishes between two states, legato and non-legato, depending on the speed of successive key-down signals, and applies legato or non-legato ADSR envelopes on a note-by-note basis. The duration of notes is not controlled, the overlapping of successive legato notes is not controlled, and the number of simultaneously sounding legato notes is not constrained. All non-legato notes are treated the same, whether they are part of a chord or a polyphonic passage.

U.S. Pat. No. 4,424,731 describes a device for selecting one of two fixed durations for percussive tones such that when many keys are played in quick succession the duration is set shorter to avoid excessive overlap. This device concerns percussive tones with fixed durations and which are incapable of being sustained indefinitely.

U.S. Pat. No. 5,365,019 describes a touch controller that adjusts the note-on velocities according to playing speed. The time interval from the immediately preceding note-off or note-on is used to adjust the touch velocity so that the degree of responsiveness to force of touch varies with playing speed. The disclosed device includes means for altering the touch effects of a new note when a note-on is received. It does not control the duration of a tone or affect any attributes of previous notes.

Changing the attack and release rates of amplitude envelopes modifies the timbre of a note slightly, but the tone is still recognized as a variant of the same instrument. Some electronic musical instruments provide mechanisms for selecting and mixing multiple instrumental timbres for each note or a range of notes.

One such feature is known as "keyboard split", whereby a predetermined contiguous range of pitches is played in a particular timbre while another disjunct range is played in a different timbre (e.g., C2–B3 bass, C4–C6 piano). The ranges and timbre assignments are preset and cannot be changed during performance.

Another timbre selection method is "velocity mapping", whereby a pair of timbres is assigned to a range of pitches. A mix of the two timbres is controlled by the force of the player's note-on actions, (e.g., at soft levels 100% timbre A and 0% timbre B, at medium levels 50/50 mixture of the two timbres, at loud levels 0% timbre A and 100% timbre B). This sort of timbre selection is subtle and difficult to control, since it is hard to reliably reproduce the same force on repeated key strokes.

SUMMARY OF THE INVENTION

It is an object of the present invention to assign an initial duration to each new note and to change the original duration of a previously sounding note upon the initiation of the next new note so as to control the articulation effect due to the overlap or space between successive notes.

It is a further object of the present invention to control the number of notes that can be sounding at the same time, automatically switching between a full polyphonic mode where many notes can sound simultaneously and a constrained melodic mode where a limited number of notes can sound at a time.

Yet another object of the present invention is to recognize and process groups of notes played simultaneously in a chord in a consolidated manner, enabling the assignment of identical musical parameters (such as duration and velocity) to each note in the chord.

A still further object of the present invention is to dynamically detect the playing style of each new note as it is played based on the time interval between successive notes, and to assign the timbre of each note depending on the playing style.

The aforesaid objects are achieved individually and in combination, and it is not intended that the present invention be construed as requiring two or more of the objects to be combined unless expressly required by the claims attached hereto.

The present invention overcomes the limitations of prior art as described above and allows greater control of articulation on any electronic musical instrument, controller, or tone generator by varying the note duration and timbre assignment in relation to the player's performing speed and a dynamically specified articulation style (degree of legato/staccato) thus producing changing amounts of overlap and detachment. According to the present invention, musical performance data, including note-on signals from a controller, is received and processed, and musical performance data, including note-on and note-off signals, is transmitted to multiple channels of a tone generator. A new note is generated for each note-on received. Each note is assigned to one of three classes: chord, polyphonic or melodic. The classification is made by measuring the time interval between successive note-on signals (called the on/on time), i.e., the time interval between the note-on time of the new note and the note-on time of the previous note. If the measured on/on time interval is less than a predetermined threshold T1, the note is classified as a chord note. If the on/on time interval is longer than a second predetermined threshold T2 (which is greater than T1), the note is classified as a polyphonic note. If the on/on time interval is between the two threshold values, the note is classified as a melodic note and the on/on time is transmitted with the note. Each of the three note types is processed separately to generate note-on and note-off signals that are sent to the tone generator as described below.

Chord notes are treated as a group, and a single duration is calculated for all the notes in the group. Note-ons for all the chord notes are sent at one time to the tone generator, and the corresponding note-off signals are sent after a time interval equal to the calculated duration has elapsed. All chord note-ons and note-offs are sent to a designated channel on the tone generator.

Polyphonic notes are treated independently. Each polyphonic note is assigned a duration proportional to the velocity of its note-on signal. A note-on signal is sent to the tone generator and the corresponding note-off signal is transmitted after a time interval equal to the calculated duration has elapsed. All polyphonic note-ons and note-offs are sent to a designated channel on the tone generator.

Melodic notes are processed such that successive tones are connected according to a specified articulation style (legato or staccato). When staccato style is specified, melodic notes are assigned a duration equal to a fixed percentage (less than 100%) of the on/on time associated with the new note. When legato style is specified, melodic notes are assigned an initial duration proportional to the velocity of the note-on signal. A note-on signal is sent to the tone generator, and the corresponding note-off signal is sent after a time interval equal to the calculated duration has elapsed. Melodic note-ons and note-offs are sent to a designated channel on the tone generator.

The actual duration of a melodic note may be modified from the originally calculated duration, as receipt of another melodic note-on while one or more melodic notes are still sounding can reschedule note-offs. Specifically, melodic notes are subject to overlap constraints. When staccato style is specified, only one melodic note can sound at a time. If a new melodic note is performed and a previous melodic note is still sounding, the older note is immediately stopped (even if its initially calculated duration has not elapsed), and the new note-on is sent to the tone generator. With legato style, if another melodic note is still sounding and a new melodic note-on is received, the previously calculated duration of the sounding note is canceled and the note is set to continue to sustain for an overlap interval which is a fixed percent of the on/on time associated with the new note. The new note-on is sent to the tone generator. The note-off for the preceding overlapping note is sent when the overlap interval has expired.

Only two melodic notes can be sounding at the same time in legato style. If a third melodic note-on is received while two are already sounding, the oldest note is immediately stopped, the other sounding note is assigned an overlap duration as described above, and the new note is started. If two successive melodic notes have the same pitch (i.e., the same note is repeated), then no overlap is performed. Instead, the note is stopped and restarted immediately.

The above and still further objects, features and advantages of the present invention will become apparent upon consideration of the following detailed description of a specific embodiment thereof, particularly when taken in conjunction with the accompanying drawings wherein like reference numerals in the various figures are utilized to designate like components.

DESCRIPTION OF THE PREFERRED EMBODIMENTS

Figure 1:
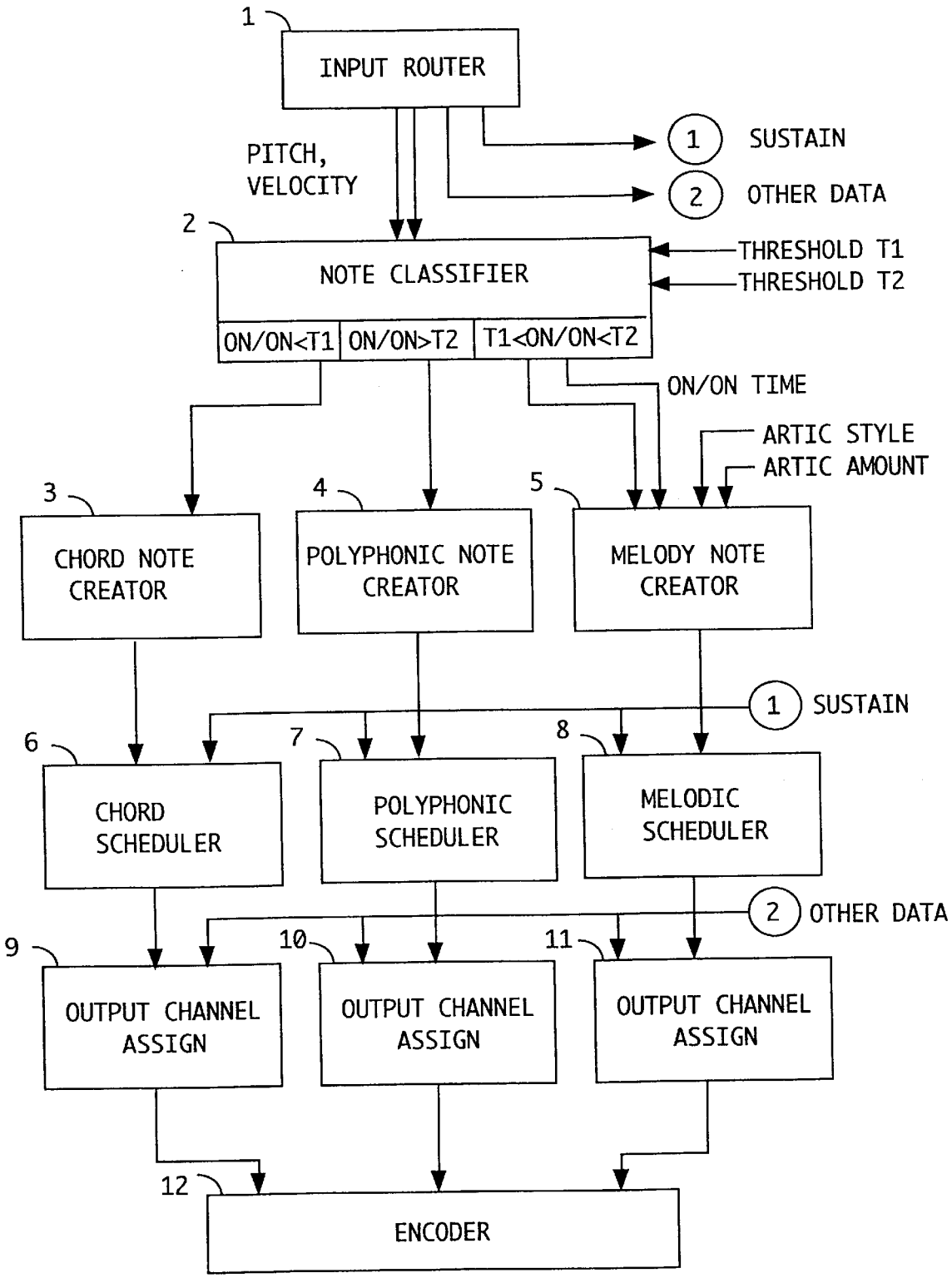
FIG. 1 is a functional block diagram of a musical performance data signal processor according to the present invention.

FIG. 1 is a functional block diagram of a musical performance data signal processor which illustrates the operating principle of the present invention. Incoming musical performance data from a controller is parsed and routed by input router 1. Note-on pitch number and velocity, and sustain pedal on/off data are retained for further processing. Note-off data is ignored. All other data is passed through to the three output channel assigns 9,10,11.

Note-on data (pitch and velocity) are routed according to the time interval from the preceding note-on (the on/on time). The note classifier 2 measures the on/on time and compares it to two threshold values T1 and T2 (T1<T2). Note-ons are routed according to whether their on/on times are less than T1, greater than T2 or between T1 and T2. Note-ons arriving at a time interval greater than T2 are treated polyphonically. Note-ons arriving within time interval T1 to T2 are treated melodically. Note-ons arriving within time interval less than T1 of each other belong to a chord. The classifier 2 collects note-ons into a list which is passed on after an interval of T1 has elapsed and no new note-ons have been received.

The chord creator 3 assigns a duration and velocity to each note in the chord. The chord creator may compute a single duration and/or velocity that is used for all the notes in a chord or assign a unique duration and/or velocity to each note. The chord scheduler 6 plays the chord by generating a note-on data for each note in the chord and keeps track of sounding notes. When the assigned duration for a note in the chord schedule has elapsed, the chord scheduler 6 generates the corresponding note-off data and removes the note from the chord schedule.

The polyphonic note creator 4 assigns a duration and velocity to a note. The polyphonic scheduler 7 plays the note by generating a note-on data and keeps track of sounding notes. When the assigned duration for a note in the polyphonic schedule has elapsed, the polyphonic scheduler 7 generates the corresponding note-off data and removes the note from the polyphonic schedule.

The melodic note creator 5 assigns a duration and velocity to the new note and alters the scheduled duration of any sounding melodic notes to achieve the desired articulation. The melodic scheduler 8 plays the note by generating a note-on data and keeps track of sounding notes. When the assigned duration for a note in the melodic schedule has elapsed, the melodic scheduler 8 generates the corresponding note-off data and removes the note from the melodic schedule.

The note-ons and note-offs from each of the three schedules 6, 7, and 8 are sent separately to output channel assigns 9, 10, 11. Each channel assign directs the performance data sent through it to be played on a designated channel of a tone generator. The channelized performance data is translated into the appropriate output data format and transmitted to one or more tone generators by the encoder 12.

Figure 2A:
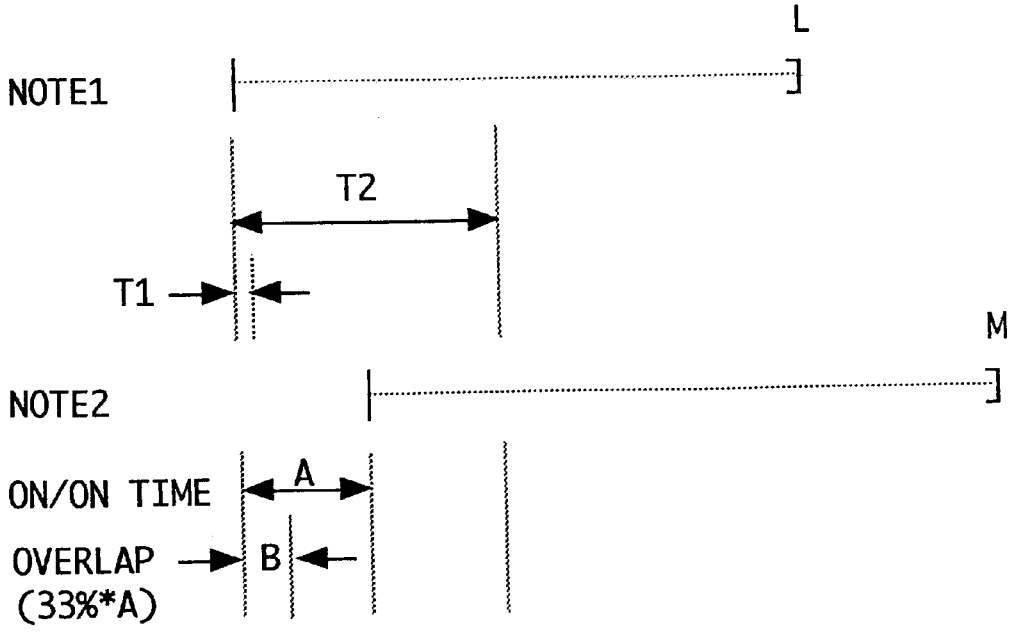
FIGS. 2A and 2B are timing diagrams showing the legato treatment of two notes according to the invention.
Figure 2B:
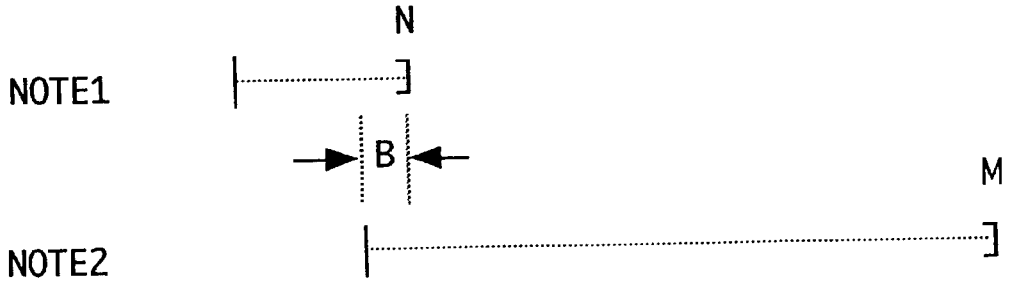

FIGS. 2A and 2B are timing diagrams illustrating the legato treatment of two notes according to the present invention. In FIG. 2A, NOTE1 is scheduled for an initial duration of L based, for example on the velocity of the note. NOTE2 arrives at onion time interval A after NOTE1. NOTE2 is scheduled for initial duration M. If these two notes are performed as originally scheduled, the result is likely to be a poorly articulated passage since the notes are played in rapid succession (less than T2 apart) and overlap by a large amount. It can be seen that A is between the two threshold amounts T1 and T2, and B is the time interval representing 33% of A. In FIG. 2B, the duration of NOTE1 has been changed to N. The time interval N ends at a time interval B after the start of NOTE2. By shortening the duration of NOTE1, the successive notes NOTE1 and NOTE2 are articulated in a connected, legato manner, while also avoiding the longer overlap originally shown.

Figure 3:
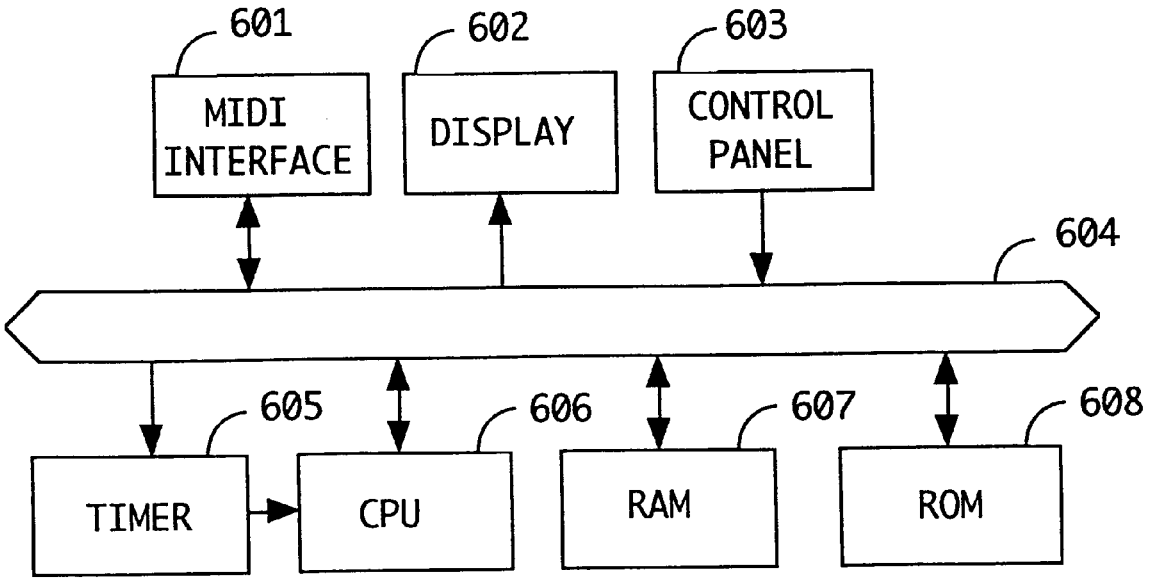
FIG. 3 is a functional block diagram of a music performance data signal processor according to an embodiment of the present invention.

FIG. 3 is a functional block diagram of a music performance data signal processor according to an embodiment of the present invention. The processor is controlled by CPU 606 which is connected to a bus 604 and communicates with other devices on the bus. The CPU can be programmed in any standard programming language, such as C or assembly language. Other devices connected to the bus are a timer 605, a RAM 607, a ROM 608, a MIDI interface 601, a display 602 and a control panel 603. The MIDI interface 601 receives MIDI data from an attached MIDI controller (not shown) and transmits MIDI data to a tone generator (not shown). The timer 605 sends interrupts to the CPU 606 at regular intervals. The CPU 606 executes the controlling program. The RAM 607 is used to store the value of working variables and controlling parameters. The ROM 608 is used to store the controlling program and table data.

The display 602 shows the current value of controlling parameters. The control panel 603 contains switches which are used to change the value of controlling parameters. The controlling parameters are:

T1, T2: time thresholds

MODE: articulation mode, one of LEGATO or STACCATO

A_PCNT: degree of articulation, expressed as a percentage

CH_IN: a MIDI input channel number CH_MELODY, CH_CHORD, CH_POLY MIDI: three MIDI output channel numbers In addition to the controlling parameters listed above, other working variables used in the disclosed embodiment are explained below:

SUST: a flag with value ON or OFF

TIME, CLOCK, CURRENT_TIME: counters

TIMEOUT: a flag with value zero or one

TIMER: a flag with value ON or OFF

PITCH_LIST: a variable storing a list of pitches

VEL_LIST: a variable storing a list of velocities

NOTE_COUNT: a counter

LAST_PITCH, NTLAST_PITCH, LAST_POLY_PITCH: variables storing a pitch number

LAST_NOTE_TYPE: a variable storing a note type, one of CHORD, MELODY, or POLY

Figure 4:
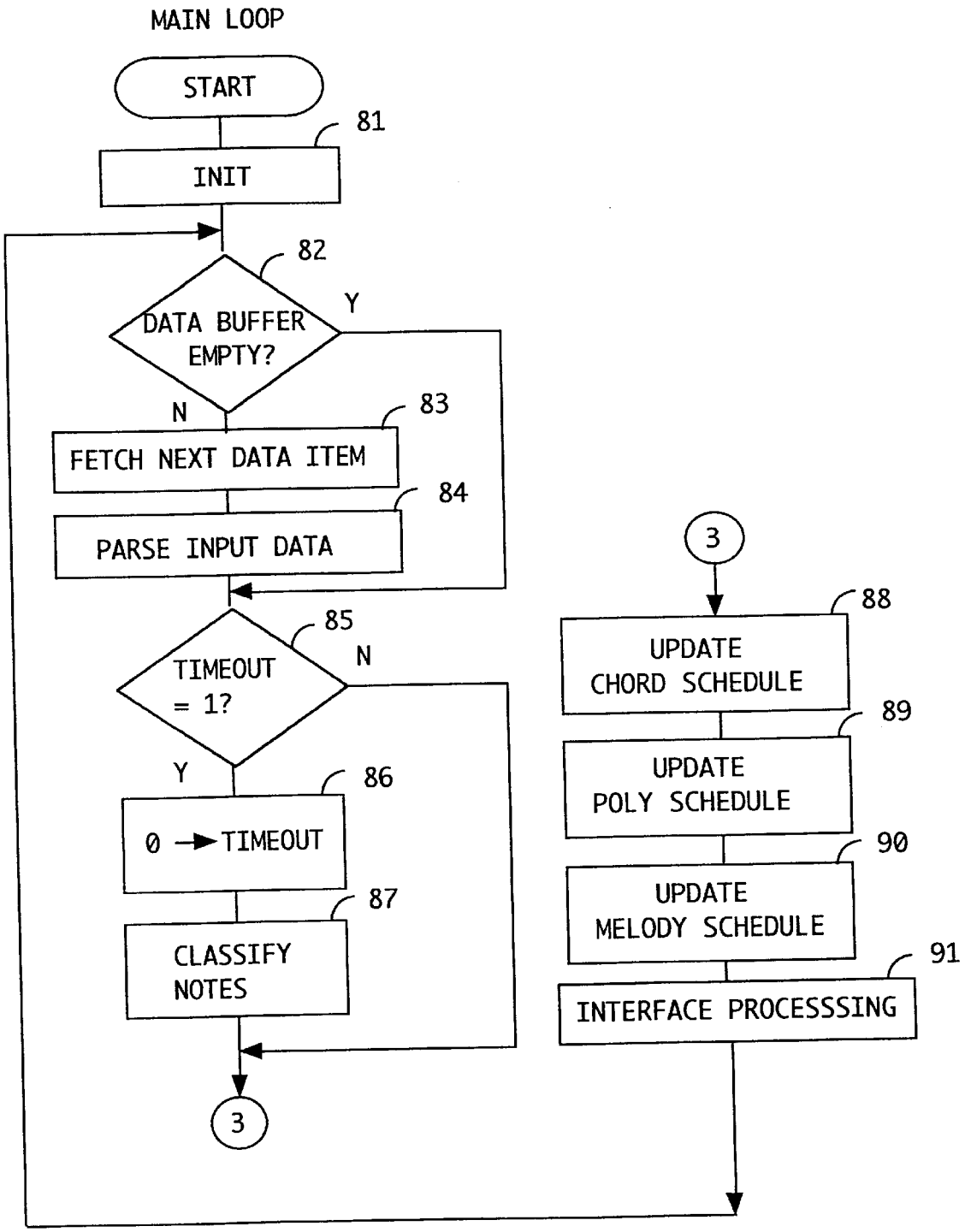
FIGS. 4 through 16 are procedural flow charts illustrating the manner in which the duration, overlap and timbre of successive notes is controlled in accordance with the present invention.

Operation of the disclosed embodiment is explained below with reference to FIGS. 4 through 16. FIG. 4 is a procedural flow chart illustrating the main control loop. When power is turned ON, the program's variables are initialized in step 81 by executing the initialization routine shown in FIG. 5. In step 82, the input buffer is examined to determine if new performance data is present. If no data is present, processing continues at step 85. If data is present, the new data is fetched in step 83, and in step 84 the parsing routine shown in FIG. 6 is executed. At step 85, the TIMEOUT flag is examined. If the flag is not set to one, processing continues at step 88. If the flag has the value one, then the interval T1 has elapsed since the timer was last started, and processing continues at step 86 where the TIMEOUT flag is reset to zero. At step 87, the new notes received are classified by executing the classify notes routine shown in FIG. 9. In steps 88, 89, and 90, the three schedules for chord, polyphonic, and melodic notes are updated according to the update schedule routine shown in FIG. 13D. In step 91, the general interface processing is performed, whereby the user can change the input/output channel routing, the threshold values, and the articulation style and degree by assigning values to the controlling parameters CH_IN, CH_MELODY, CH_CHORD, CH_POLY, T1, T2, MODE, and A_PCNT. Steps 82 through 91 are repeated until the power is turned OFF.

Figure 5:
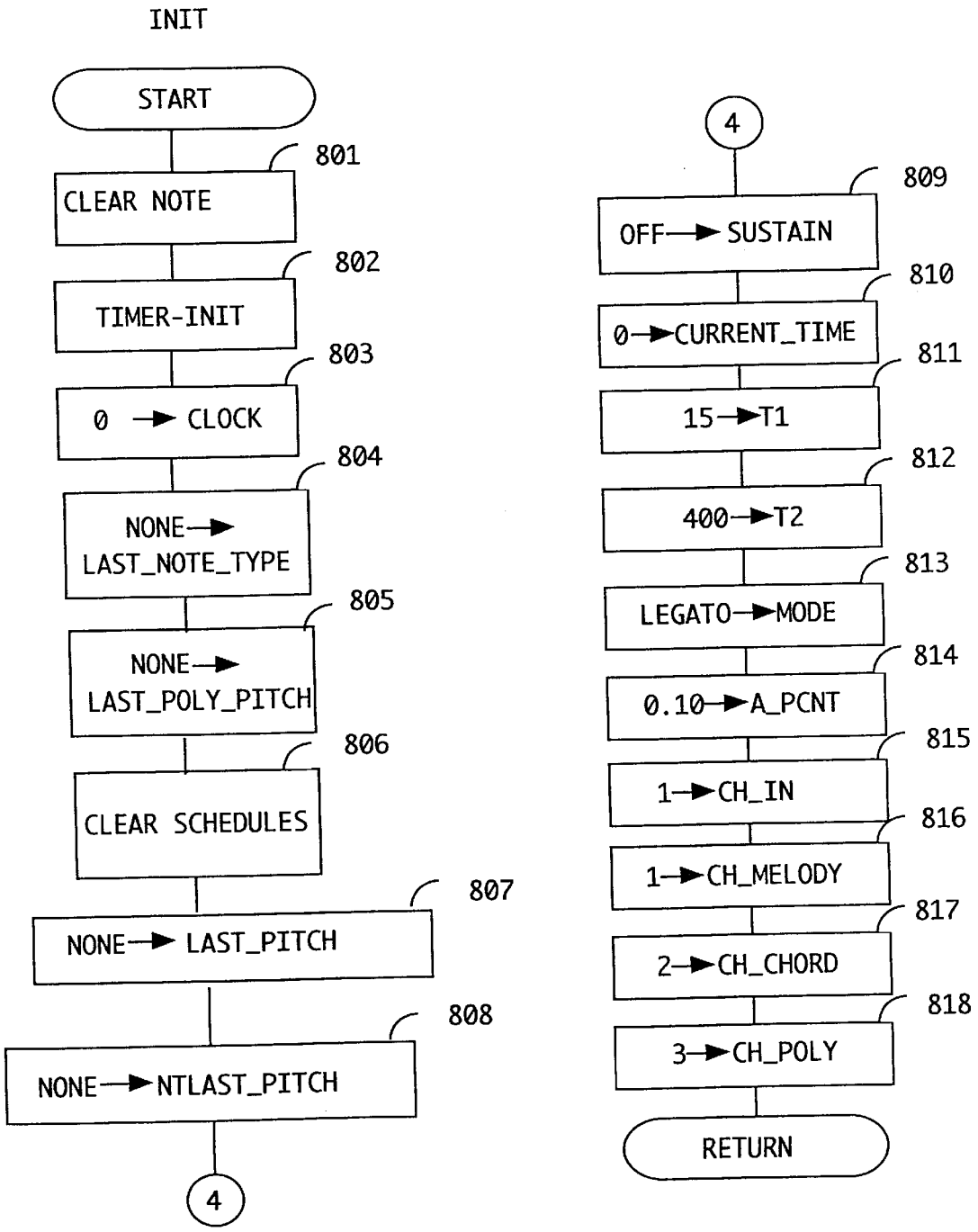
Figure 6:
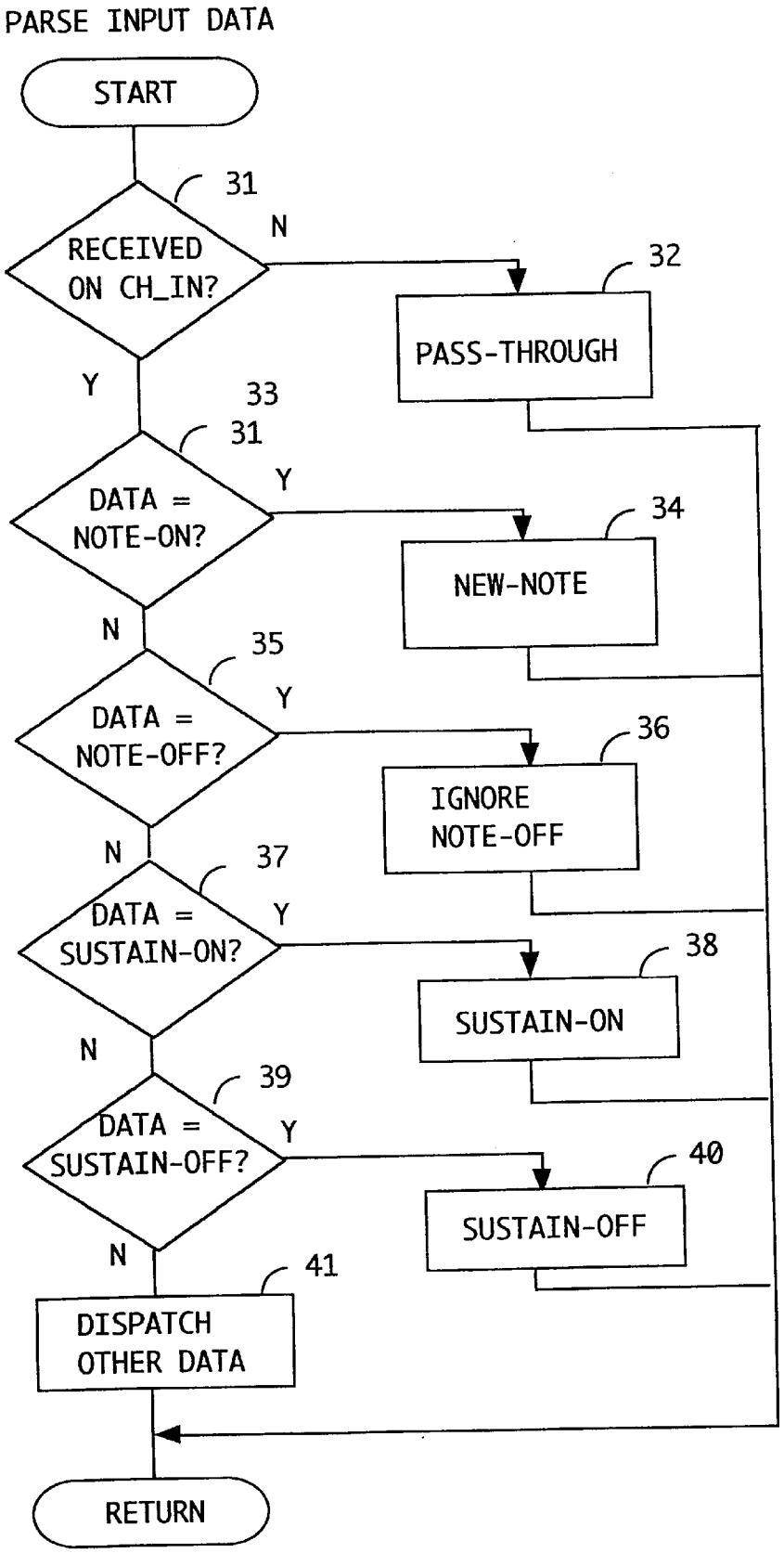
Figure 13A:
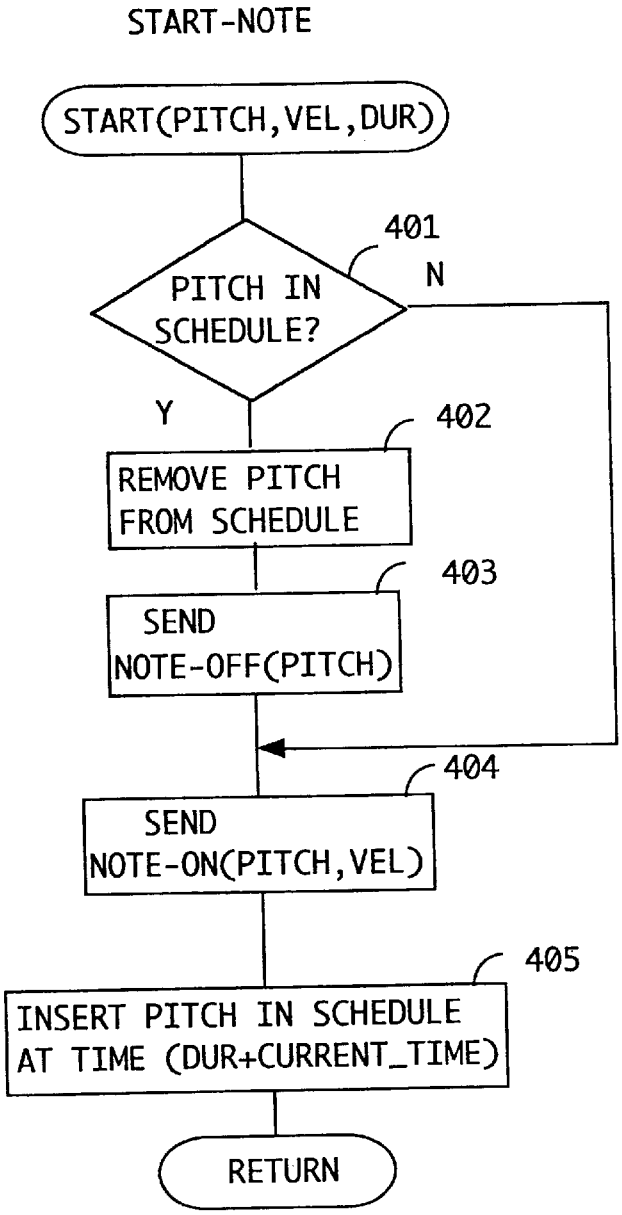
Figure 13B:
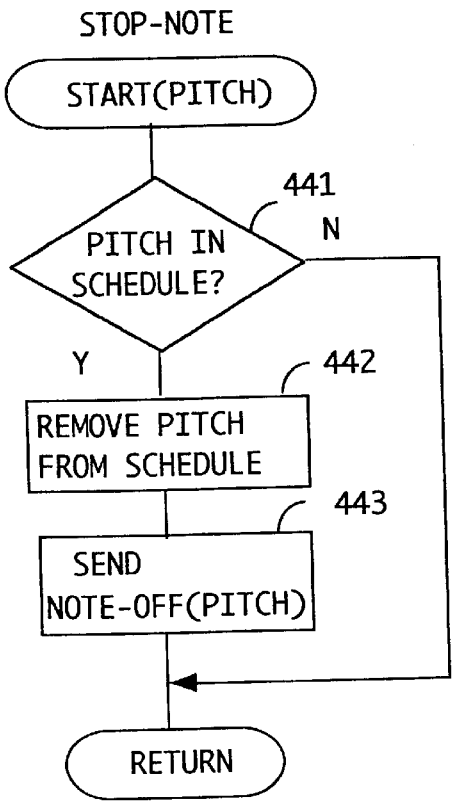
Figure 13C:
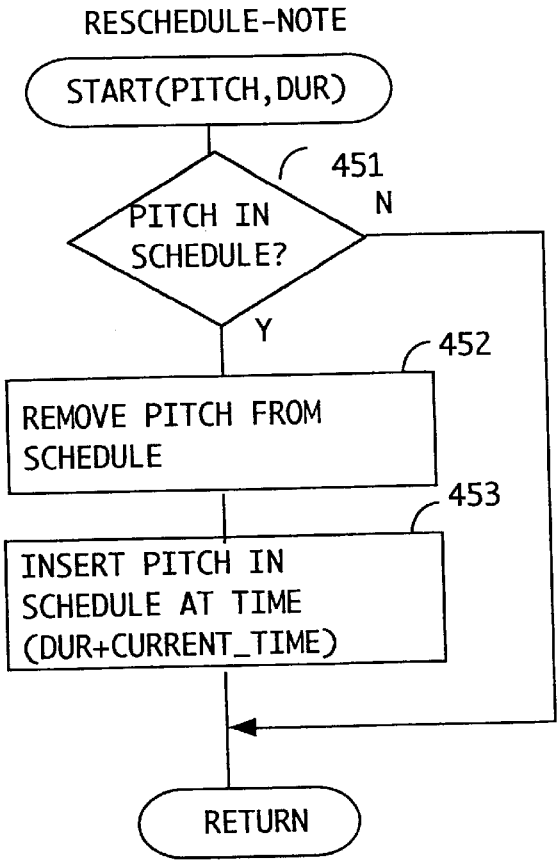

The following steps are executed in the initialization routine shown in FIG. 5. In step 801, the variables used to accumulate new notes are cleared by executing the clear note routine shown in FIG. 16. In step 802, the interval timer counting the interval T1 is initialized by calling the init timer routine shown in FIG. 14B. In step 803, the clock measuring on/on time between notes is reset to zero. In step 804, the variable LAST_NOTE_TYPE is set to NONE. In step 805, the variable LAST_POLY_PITCH is set to NONE. In step 806, the clear schedule routine shown in FIG. 13E is executed upon the chord schedule, the melody schedule, and the polyphonic schedule. In step 807, the variable LAST_PITCH is set to NONE. In step 808, the variable NLAST_PITCH is set to NONE. In step 809, the SUSTAIN flag is set to OFF. In step 810, the variable CURRENT_TIME is set to zero. In step 811, the variable T1 is set to 15. In step 812, the variable T2 is set to 400. In step 813, the variable MODE is set to LEGATO. In step 814, the variable A_PCNT is set to 0.10. In step 815, the variable CH_IN is set to channel 1. In step 816, the variable CH_MELODY is set to channel 1. In step 817, the variable CH_CHORD is set to channel 2. In step 818, the variable CH_POLY is set to channel 3. Processing then returns to step 82 of the main loop shown in FIG. 4.

Figure 7:
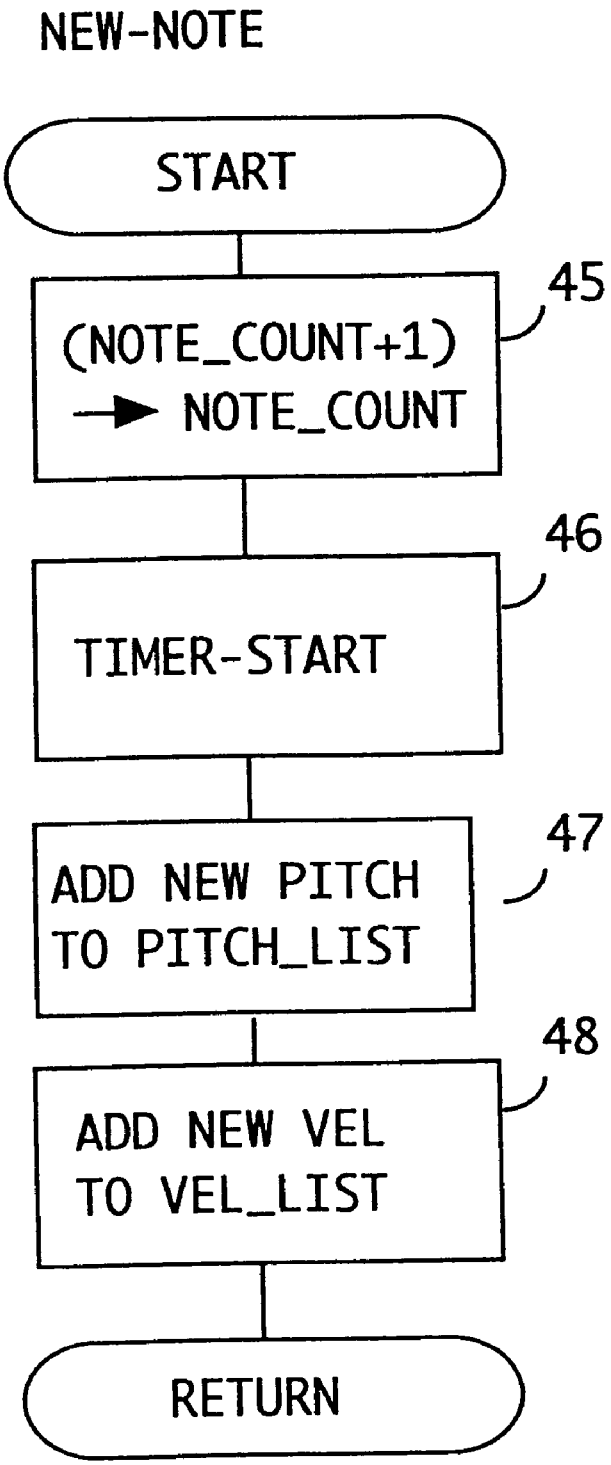
Figure 8A:
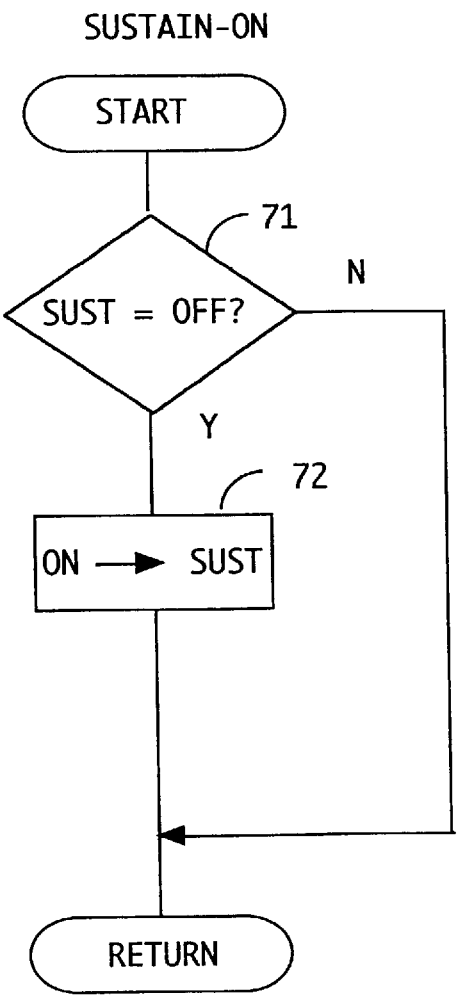
Figure 8B:
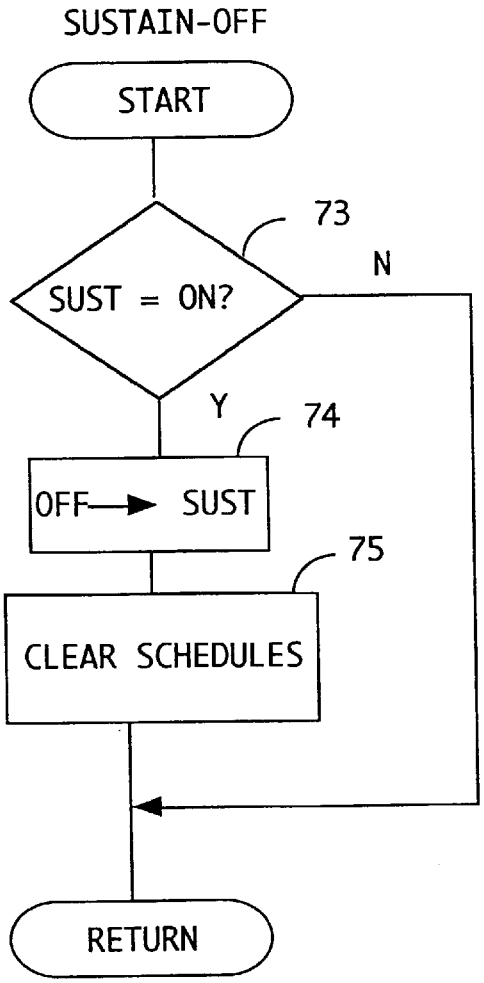

FIG. 6 is a procedural flow chart of the parse input data routine shown in step 84 of FIG. 4. In step 31, the new data is examined to determine if it was received on the input channel CH_IN. If so, processing continues at step 33. If not, processing continues at step 32 where the data is re-transmitted on the same channel on which it was received and processing returns to step 85 of the main loop shown in FIG. 4. In step 33, the new data is examined to determine if it is a note-on event. If so, then in step 34, the note-on routine shown in FIG. 7 is executed and processing returns to step 85 of the main loop shown in FIG. 4. In step 35, the new data is examined to determine if it is a note-off event. If so, then in step 36, the note-off data is thrown away and processing returns to step 85 of the main loop shown in FIG. 4. In step 37, the new data is examined to determine if it is a sustain ON event. If so, then in step 38, the sustain-on routine shown in FIG. 8A is executed and processing returns to step 85 of the main loop shown in FIG. 4. In step 39, the new data is examined to determine if it is a sustain OFF event. If so, then in step 40, the sustain-off routine shown in FIG. 8B is executed and processing returns to step 85 of the main loop shown in FIG. 4. If the new data is not a note-on, note-off, or sustain event, processing continues at step 41 where the data is sent directly to all three output channels CH_MELODY, CH_CHORD, CH_POLY. Processing then returns to step 85 of the main loop shown in FIG. 4.

FIG. 7 is a flow chart of the new note routine shown in step 34 of FIG. 6. In step 45, the variable NOTE_COUNT is incremented. In step 46, the timer measuring interval T1 is started by executing the timer start routine shown in FIG. 14A. In step 47, the pitch of the note-on event is extracted and added to the list of pitches PITCH_LIST. In step 48, the velocity of the note-on event is extracted and added to the list of velocities VEL_LIST. Processing then returns to step 85 of the main loop shown in FIG. 4.

FIG. 8A is a flow chart of the sustain on routine shown in step 38 of FIG. 6. At step 71, the current value of the SUSTAIN flag is tested. If the value is not OFF, then processing returns to step 85 of the main loop shown in FIG. 4. If the value of the SUSTAIN flag is OFF, then processing continues at step 72 where SUSTAIN flag is set to ON. Processing then returns to step 85 of the main loop shown in FIG. 4.

FIG. 8B is a flow chart of the sustain off routine shown in step 40 of FIG. 6. At step 73, the current value of the SUSTAIN flag is tested. If the value is not ON, then processing returns to step 85 of the main loop shown in FIG. 4. If the value of the SUSTAIN flag is ON, then processing continues at step 74 where SUSTAIN flag is set to OFF. In step 75 all the currently sounding notes are stopped by executing the clear schedule routine shown in FIG. 13E upon the chord schedule, the melody schedule, and the polyphonic schedule. Processing then returns to step 85 of the main loop shown in FIG. 4.

Figure 9:
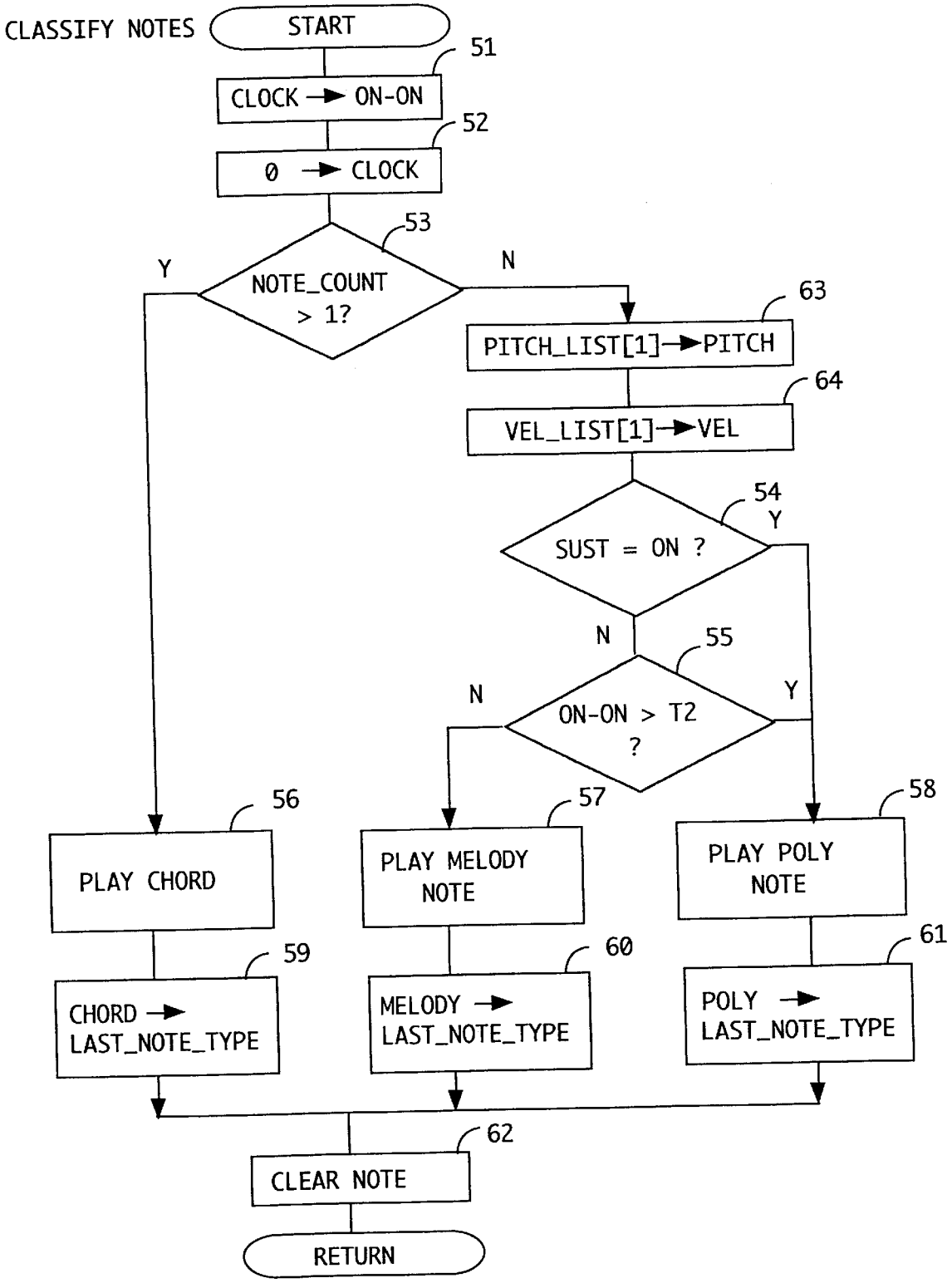
Figure 10:
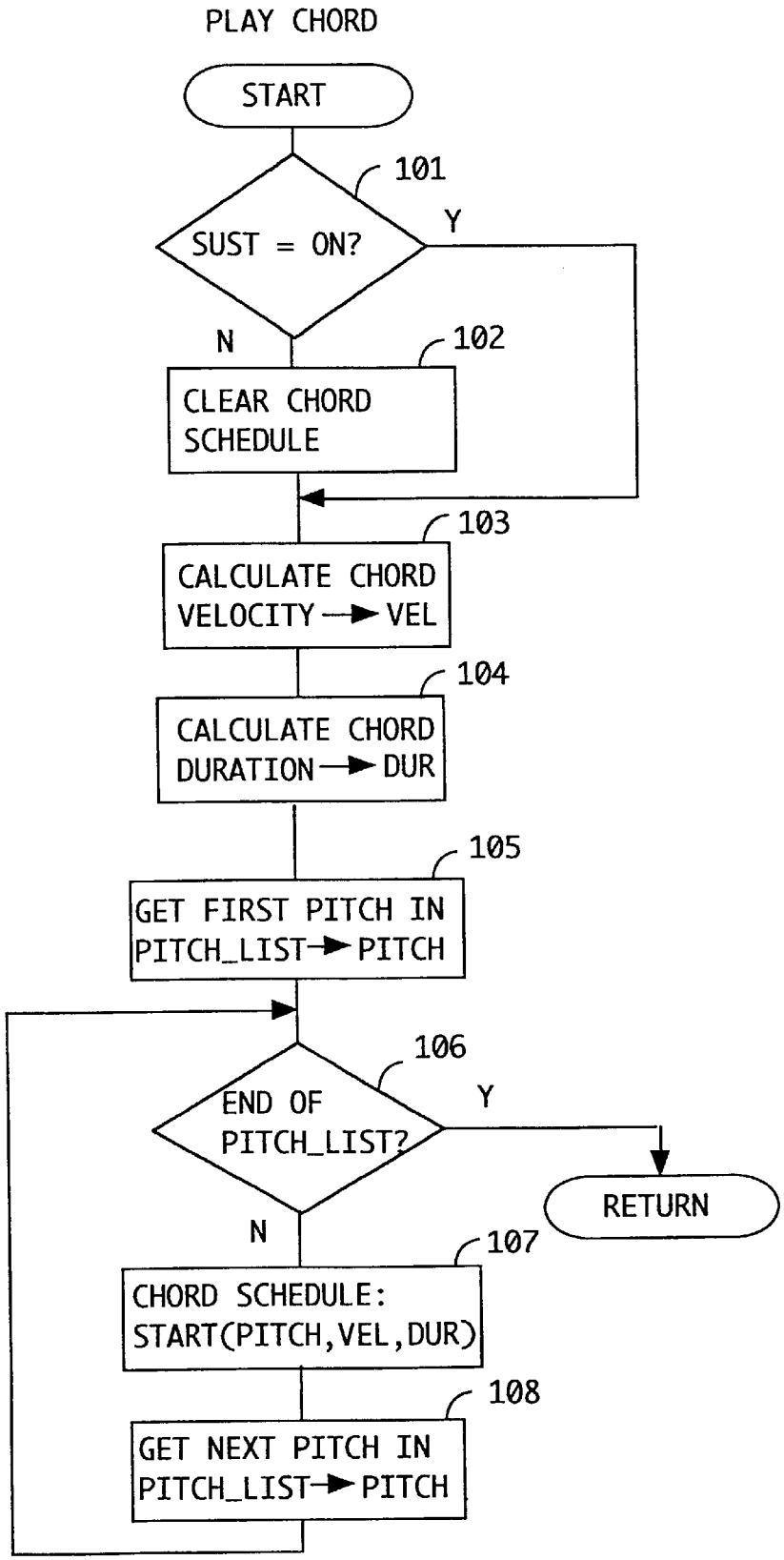

FIG. 9 is a flow chart of the classify routine shown in step 87 of FIG. 4. At step 51, the current value of the clock measuring on/on time is stored in the variable ON—ON. In step 52, the clock measuring on/on time between notes is reset to zero. In step 53 the counter indicating the number of new notes received is examined. If the counter's value is greater than one, then a chord has occurred and processing continues at step 56 where the play chord routine shown in FIG. 10 is executed. In step 59, the variable LAST_NOTE_TYPE is set to record that a note of type CHORD was the last note performed. Processing then continues at step 62.

If the note count in step 53 is not greater than one, then there is only a single note to play and processing continues at step 63 where the first pitch in PITCH_LIST is assigned to variable PITCH. In step 64, the first velocity in VEL_LIST is assigned to variable VEL. In step 54, the value of the SUSTAIN flag is tested. If SUSTAIN is ON, then all notes are treated polyphonically and processing continues at step 58. If sustain is not ON, then processing continues at step 55 where the on/on time for the note is examined. If the on/on time is greater than threshold T2, the note is treated polyphonically and processing continues at step 58. Otherwise, the note is treated melodically and processing continues at step 57.

Figure 11:
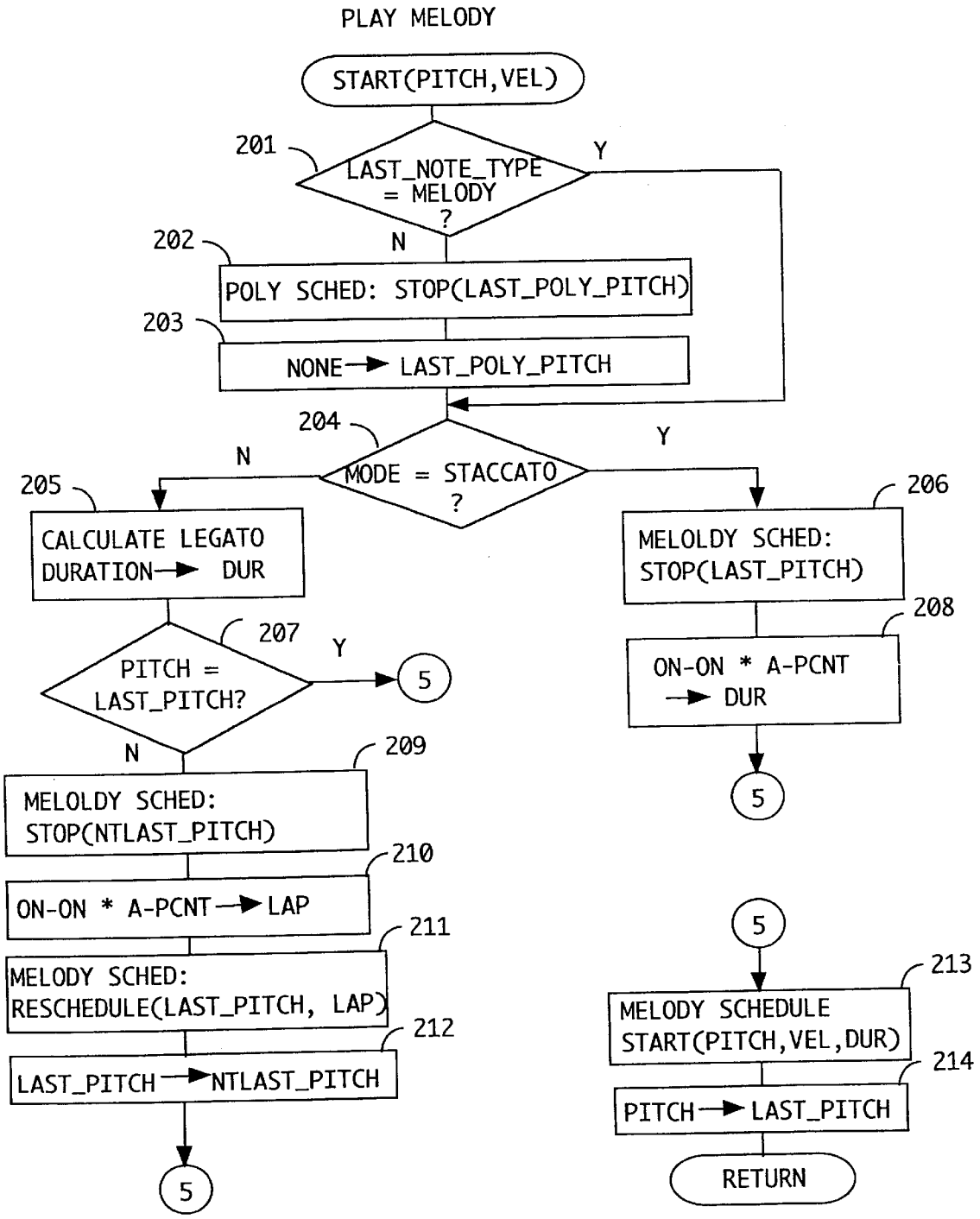

At step 57, the play melodic note routine shown in FIG. 11 is executed. In step 60, the variable LAST_NOTE_TYPE is set to record that a note of type MELODY was the last note performed. Processing then continues at step 62.

Figure 12:
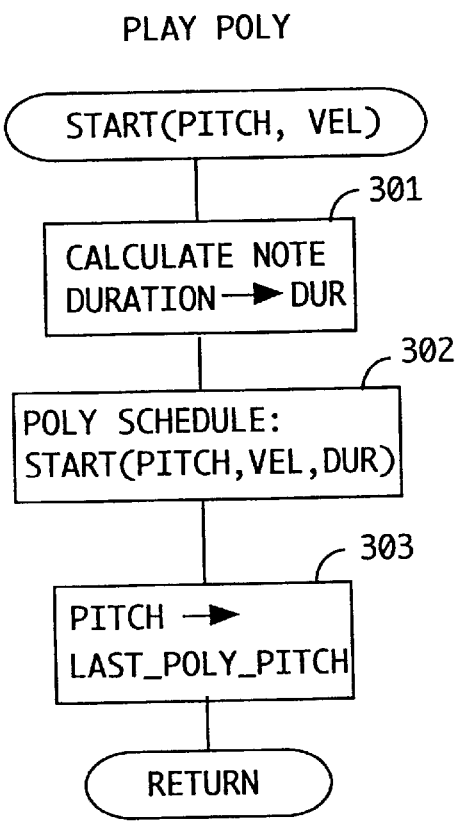

At step 58, the play polyphonic note routine shown in FIG. 12 is executed. In step 61, the variable LAST_NOTE_TYPE is set to record that a note of type POLY was the last note performed. Processing then continues at step 62.

Figure 16:
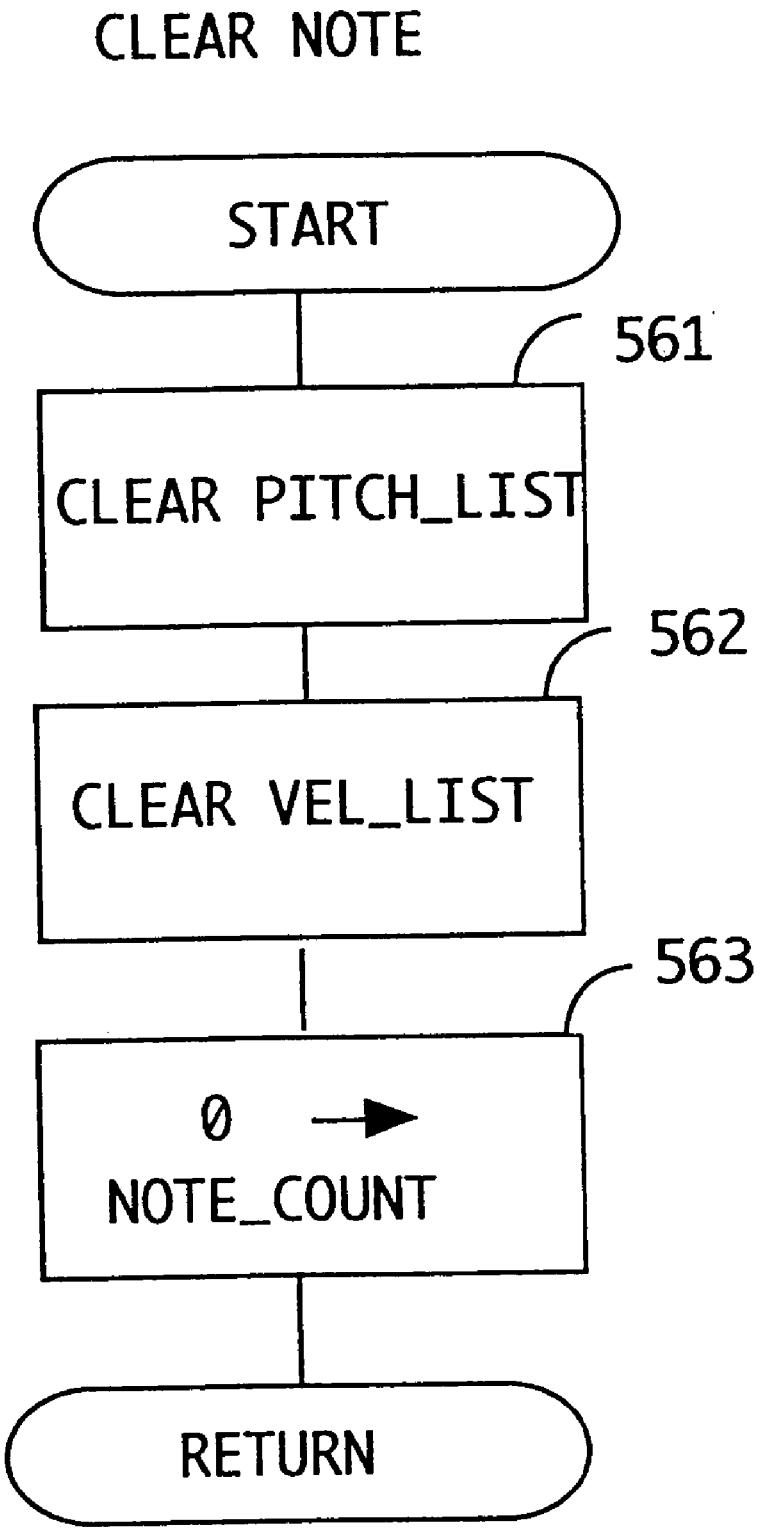

In step 62, the variables used to accumulate new notes are cleared by executing the clear note routine shown in FIG. 16. Processing then continues at step 88 of FIG. 4.

FIG. 10 is a flow chart of the play chord routine shown in step 56 of FIG. 9. When processing arrives at step 101, the list PITCH_LIST contains the list of pitches of the notes in the chord and the list VEL_LIST contains the list of velocities of the notes in the chord. 12 At step 101, the SUST flag is examined. If its value is ON, processing continues at step 103. If its value is not ON, then at step 102, the clear schedule routine shown in FIG. 13E is executed on the chord schedule. This stops all the notes sounding in the current chord if one is playing.

In step 103, a single velocity is calculated for all the notes in the chord and placed in the variable VEL. There are a variety of ways to determine the velocity. In the preferred embodiment, the maximum velocity from VEL_LIST is used.

In step 104, a single duration for all the notes in the chord is calculated and placed in the variable DUR. There are a variety of ways to calculate a duration. In the preferred embodiment, a table lookup is performed, searching a table of velocity and duration pairs and selecting the duration corresponding to the velocity value calculated at step 103.

In step 105, the first pitch in PITCH_LIST is retrieved and placed in the variable PITCH. In step 106, a test is made whether the most recent retrieval from PITCH_LIST failed because the end of the list was encountered. If the end of the list was encountered, processing returns to step 59 in FIG. 9. If the end was not encountered, then a value for PITCH was retrieved and processing continues at step 107 where the start note routine shown in FIG. 13A is executed on the chord schedule with pitch value PITCH, velocity VEL and duration DUR. This causes one new note in the chord to begin sounding. At step 108, the next pitch in PITCH_LIST is retrieved. Processing then continues at step 106. Steps 106, 107, 108 are executed repeatedly until all the pitches in PITCH_LIST have been added to the chord schedule. Processing then returns to step 59 in FIG. 9.

FIG. 11 is a flow chart of the play melody routine shown in step 57 of FIG. 9. In step 201, the value of the variable LAST_NOTE_TYPE is examined. If the value is MELODY the processing continues at step 204. If the value is not MELODY, then step 202 is executed. At step 202, the stop note routine shown in FIG. 13B is executed on the poly schedule with pitch value LAST_POLY_PITCH. In step 203, the value of LAST_POLY_PITCH is set to NONE.

In step 204, the value of the register MODE is examined. If MODE is set to staccato, processing continues at step 206. If MODE is not STACCATO, then it is LEGATO and processing continues at step 205.

At step 206, the stop note routine shown in FIG. 13B is executed on the melody schedule with pitch value LAST_PITCH. In step 208, the duration of a note is assigned according to staccato articulation. The value of ON—ON is multiplied by the articulation percentage in A-PCNT. The result is placed in the variable DUR. Processing then continues at step 213.

In step 205, the duration of a note is assigned according to legato articulation. There are a variety of ways to calculate duration. In the preferred embodiment, a table lookup is performed, searching a table of velocity and duration pairs and selecting the duration corresponding to the velocity value in the variable VEL. In step 207, the value of PITCH is compared to the value of LAST_PITCH. If they are the same, then the same melodic pitch has been played twice in a row and processing continues at step 213. If they are not the same, processing continues at step 209.

In step 209, the stop note routine shown in FIG. 13B is executed on the melody schedule with pitch value NTLAST_PITCH. In step 210, the overlap interval is calculated by multiplying the on/on time stored in ON—ON with the articulation percentage in A-PCNT, and the result is stored in LAP. In step 211, the reschedule note routine shown in FIG. 13C is executed on the melody schedule with pitch value LAST_PITCH and duration value LAP. In step 212, the value of LAST_PITCH is stored in the variable NTLAST_PITCH. Processing continues at step 213.

At step 213, the start note routine shown in FIG. 13A is executed on the melody schedule with pitch value PITCH, velocity VEL and duration DUR. This causes the new melodic note to begin to play. In step 214, the value of PITCH is stored in the variable LAST_PITCH. Processing returns to step 60 in FIG. 9.

FIG. 12 is a flow chart of the play poly routine shown in step 58 of FIG. 9. In step 301, the duration is assigned. There are a variety of ways to calculate duration. In the preferred embodiment, a table lookup is performed, searching a table of velocity and duration pairs and selecting the duration corresponding to the velocity value in the variable VEL. In step 302, the start note routine shown in FIG. 13A is executed on the poly schedule with pitch value PITCH, velocity VEL and duration DUR. In step 303, the value of PITCH is stored in the variable LAST_POLY_PITCH. Processing returns to step 61 in FIG. 9.

FIGS. 13A through 13E are flow charts of routines that process a note schedule. A note schedule is an ordered list of pairs of numbers representing ending time and pitch. The schedule is sorted by increasing ending times. Note that there are three separate schedules representing the three types of notes (chord schedule, melody schedule, poly schedule), and the same algorithms are used to perform the indicated functions on a specified schedule. Note-on and note-off messages generated by these routines are sent to the output channel associated with the note-type of the schedule. The chord schedule transmits on the channel specified in the variable CH_CHORD, the melody schedule transmits on the channel specified in the variable CH_MELODY, and the poly schedule transmits on the channel specified in the variable CH_POLY.

FIG. 13A is a flow chart of the start note routine which is called from multiple points in the program whenever a new note is added to a schedule. The routine is called with three arguments: PITCH, VEL, and DUR. In step 401, the schedule is examined to determine if the requested pitch is already in the schedule. If it is not, then processing proceeds at step 404. If the pitch is in the schedule, then it is currently playing and it must be stopped and restarted. In step 402, the pitch is removed from the schedule. In step 403, a note-off for the pitch is transmitted on the channel assigned to the schedule. In step 404, a note-on for the pitch is transmitted on the channel assigned to the schedule. In step 405, the current system time is read from the system clock and the pitch is inserted in the schedule with the ending time of (DUR+CURRENT_TIME). Insertion in the schedule is by ascending sorted order on ending time. Processing then returns to the calling routine.

FIG. 13B is a flow chart of the stop note routine which is called from multiple points in the program. The routine is called with the argument PITCH. In step 441, the schedule is searched to determine if the requested pitch is on the schedule. If the pitch is not on the schedule, processing immediately returns to the calling routine. If the requested pitch is on the schedule, processing continues at step 442 where the pitch is removed from the schedule. In step 443, a note-off for the pitch is transmitted on the channel assigned to the schedule. Processing then returns to the calling routine.

FIG. 13C is a flow chart of the reschedule note routine which is called from step 211 in FIG. 11. The routine is called with two arguments PITCH and DUR. In step 451, the schedule is searched to determine if the requested pitch is on the schedule. If the pitch is not on the schedule, processing immediately returns to the calling routine. If the requested pitch is on the schedule, processing continues at step 452 where the pitch is removed from the schedule. At step 453 the current system time is read from the system clock and the pitch is inserted in the schedule with the ending time of (DUR+CURRENT_TIME). Insertion in the schedule is by ascending sorted order on ending time. Processing then returns to the calling routine.

Figure 13D:
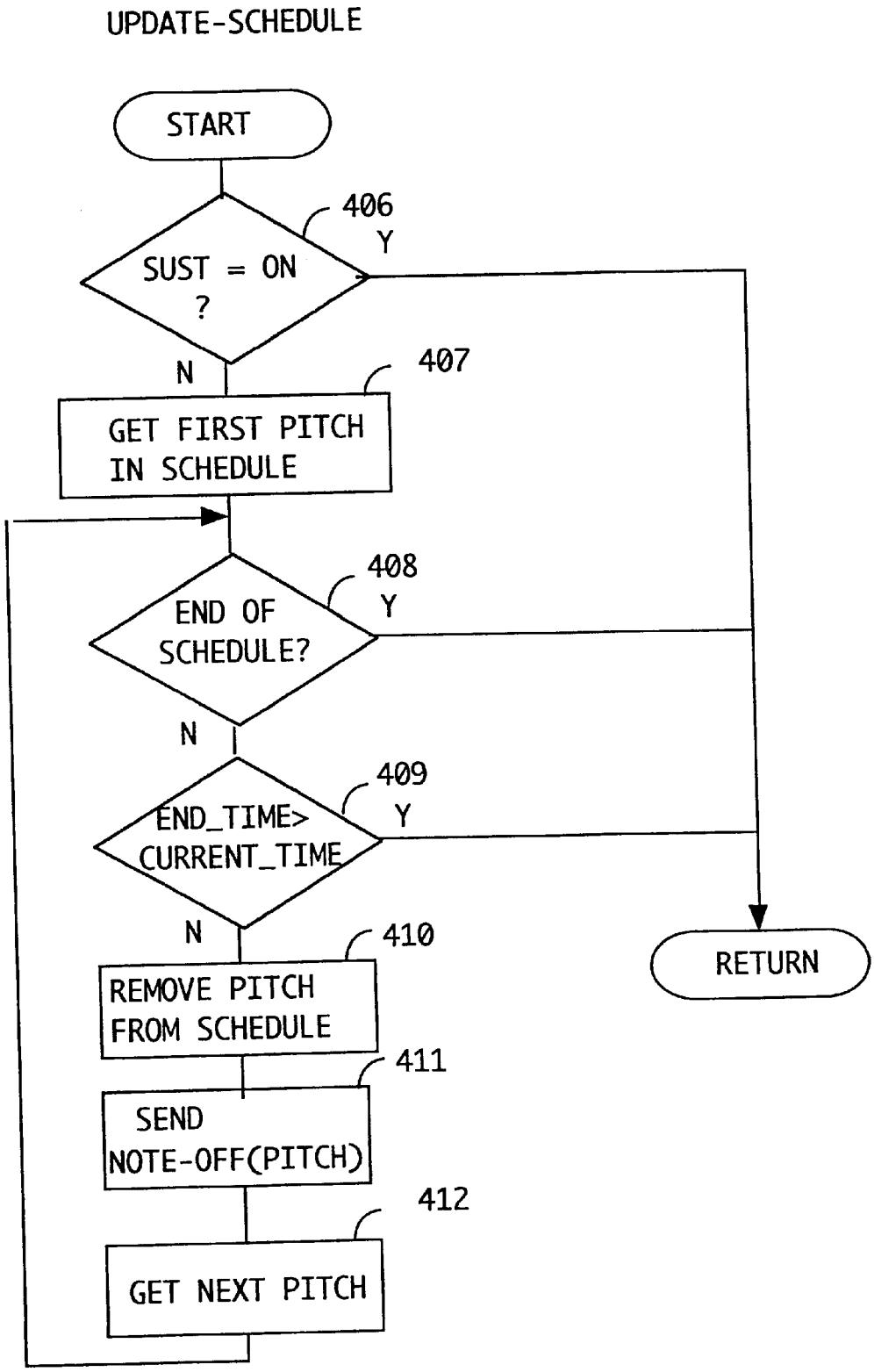
Figure 13E:
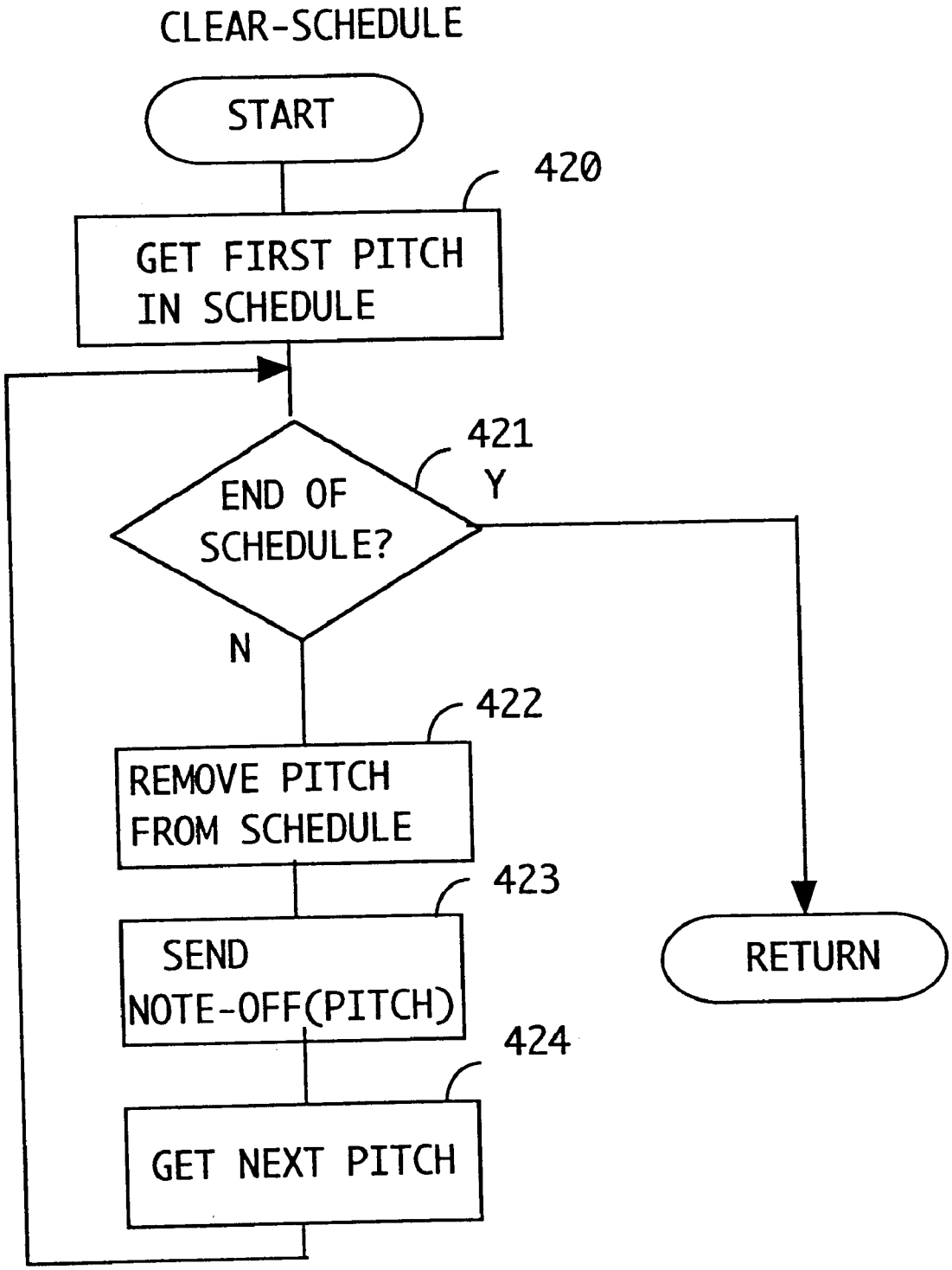

FIG. 13D is a flow chart of the update schedule routine which is called from steps 88, 89 and 90 in FIG. 4. In step 406, the value of the SUST flag is examined to determine if the sustain function is enabled. If sustain is ON, then processing continues by immediately returning to the calling routine. This prevents note-offs from occurring while sustain is enabled. If sustain is OFF, then processing continues at step 407 where the first pitch in the schedule is retrieved. In step 408, a test is made whether the most recent retrieval from the schedule failed because the end of the schedule was encountered. If the end of the schedule was encountered, processing returns to the calling routine. Otherwise, a pitch was retrieved from the schedule and processing continues in step 409 where the ending time retrieved from the schedule is compared to CURRENT_TIME. If the end time of the pitch is not greater than CURRENT_TIME, then its duration has elapsed and the note is stopped. Processing continues in step 410. If the end time of the pitch is greater than CURRENT_TIME, then its duration has not elapsed and, since the pitches are stored in the schedule in end-time order, no other pitches on the schedule will have elapsed, so processing immediately returns to the calling routine. In step 410, the pitch that was determined to have elapsed in step 409 is removed from the schedule. In step 411, a note-off for the pitch is transmitted on the channel associated with the schedule. In step 412, the next pitch in the schedule is retrieved and processing continues at step 408. Steps 408 through 412 are executed repeatedly until the end of the schedule is reached or no more notes with elapsed duration are encountered.

FIG. 13E is a flow chart of the clear schedule routine which is called from multiple points in the program. In step 420, the first pitch in the schedule is retrieved. In step 421, a test is made whether the most recent retrieval from the schedule failed because the end of the schedule was encountered. If the end of the schedule was encountered, processing returns to the calling routine. Otherwise, a pitch was retrieved from the schedule and processing continues in step 422. In step 422, the retrieved pitch is removed from the schedule. In step 423, a note-off for the pitch is transmitted on the channel associated with the schedule. In step 424, the next pitch in the schedule is retrieved and processing continues at step 421. Steps 421 through 424 are executed repeatedly until the end of the schedule is reached and all notes on the schedule have been stopped and removed.

Figure 14A:
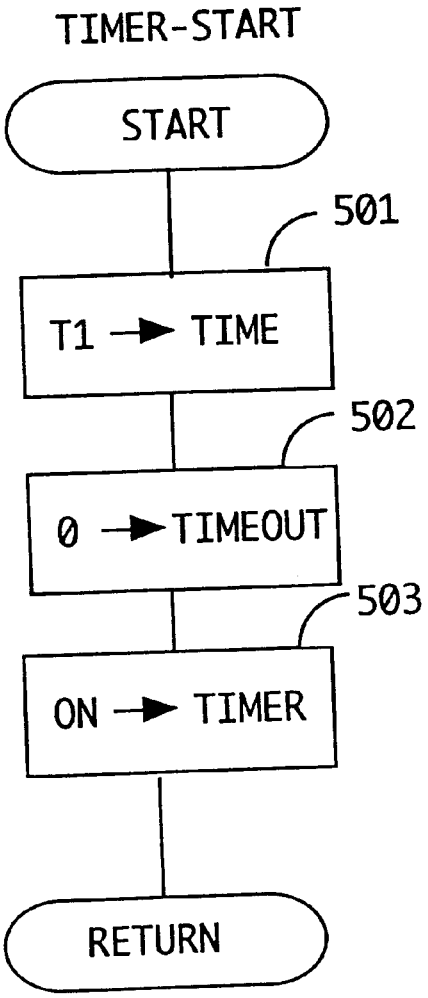

FIG. 14A is a flow chart of the timer start routine which is called from step 46 in FIG. 7. In step 501, the value of threshold T1 is placed in variable TIME. In step 502, the flag TIMEOUT is set to zero. In step 503, the value of flag TIMER is set to ON. Processing returns to step 47 in FIG. 7.

Figure 14B:
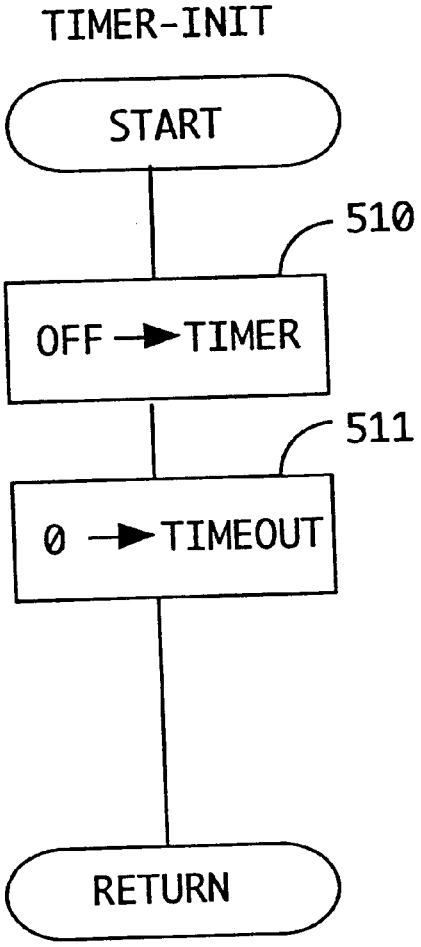

FIG. 14B is a flow chart of the timer init routine which is called from step 802 in FIG. 5. In step 510, the value of the flag TIMER is set to OFF. In step 511, the value of the flag TIMEOUT is set to zero. Processing returns to step 803 in FIG. 5.

Figure 15:
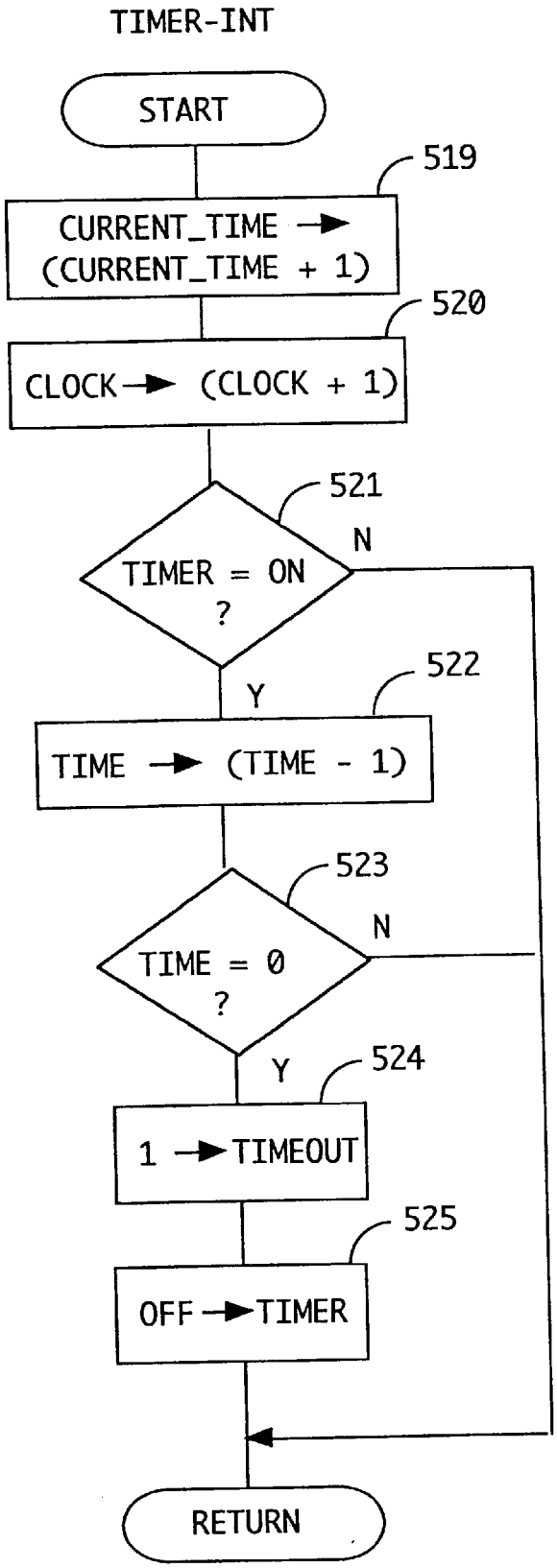

FIG. 15 is a flow chart of the timer interrupt routine. This routine is called at regular intervals, preferably every millisecond. In step 519, the value of the counter CURRENT_TIME is incremented. In step 520, the value of the counter CLOCK is incremented. In step 521 the value of flag TIMER is checked. If the value is OFF, then processing immediately returns to the calling routine. If the value is ON, then processing continues at step 522. In step 522, the value of the counter TIME is decremented by one. In step 523, the value of counter TIME is tested. If TIME is not zero, then processing immediately returns to the calling routine. If TIME is zero, processing continues at step 524 where the value of flag TIMEOUT is set to one. In step 525, the value of flag TIMER is set to OFF. Processing then returns to the calling routine.

FIG. 16 is a flow chart of the clear note routine which is called from multiple points in the program. In step 561, all values are removed from the variable PITCH_LIST. In step 562, all values are removed from the variable VEL_LIST. In step 563, the value of counter NOTE_COUNT is set to zero. Processing then returns to the calling routine.

While a preferred embodiment has been used to describe the present invention, the scope of the invention is limited thereto. The invention may be embodied in an electronic musical instrument containing both a controller and a tone generator, or the invention may be embodied in a controller alone or in a tone generator alone, or in a sequencer program. The CPU may be replaced by a floating point gate array (FPGA), discrete electrical circuitry, or a system of interconnected integrated circuits.

In the preferred embodiment, the performance data is transmitted and received as MIDI data. The present invention is not limited to this format, and it is also possible to receive and transmit performance data in a non-MIDI format. It is also possible to receive performance data in one format and transmit performance data in a different format.

In the preferred embodiment, note-offs are ignored. When the controller is capable of sending note-off signals, it is also possible to process them so that the duration of chords and polyphonic notes is controlled by the player's actions but the advantage of automatic legato and staccato articulation for melodic notes is retained. This is achieved as follows: Remove steps 88 and 89 in FIG. 4 so that the update routine for chord and poly schedules is never executed. In place of step 36 FIG. 6, the stop note routine shown in FIG. 13B is executed on the chord and poly schedules with the pitch of the note-off.

In the preferred embodiment, the sustain function is controlled by one sustaining signal and all three note types and their schedules respond to that signal. It is also possible to receive separate sustaining signals for each type of note and control the sustain functions independently. For instance, one sustain signal could control chordal sustain, and a second signal could control melodic and polyphonic sustain.

In the preferred embodiment, only pitch number and velocity performance data are treated. It is also possible to receive and re-transmit other performance data that is associated with note-on signals, and to compute and transmit performance data associated with note-off signals. It is also possible in the case of chords to choose a single representative value for each additional type of performance data so that every note in a chord is performed with the same values.

In the preferred embodiment, single representative values for each type of performance data are chosen for every note in a chord. The present invention is not limited to this, and the actual performance data associated with each note may be transmitted.

Figure 17:
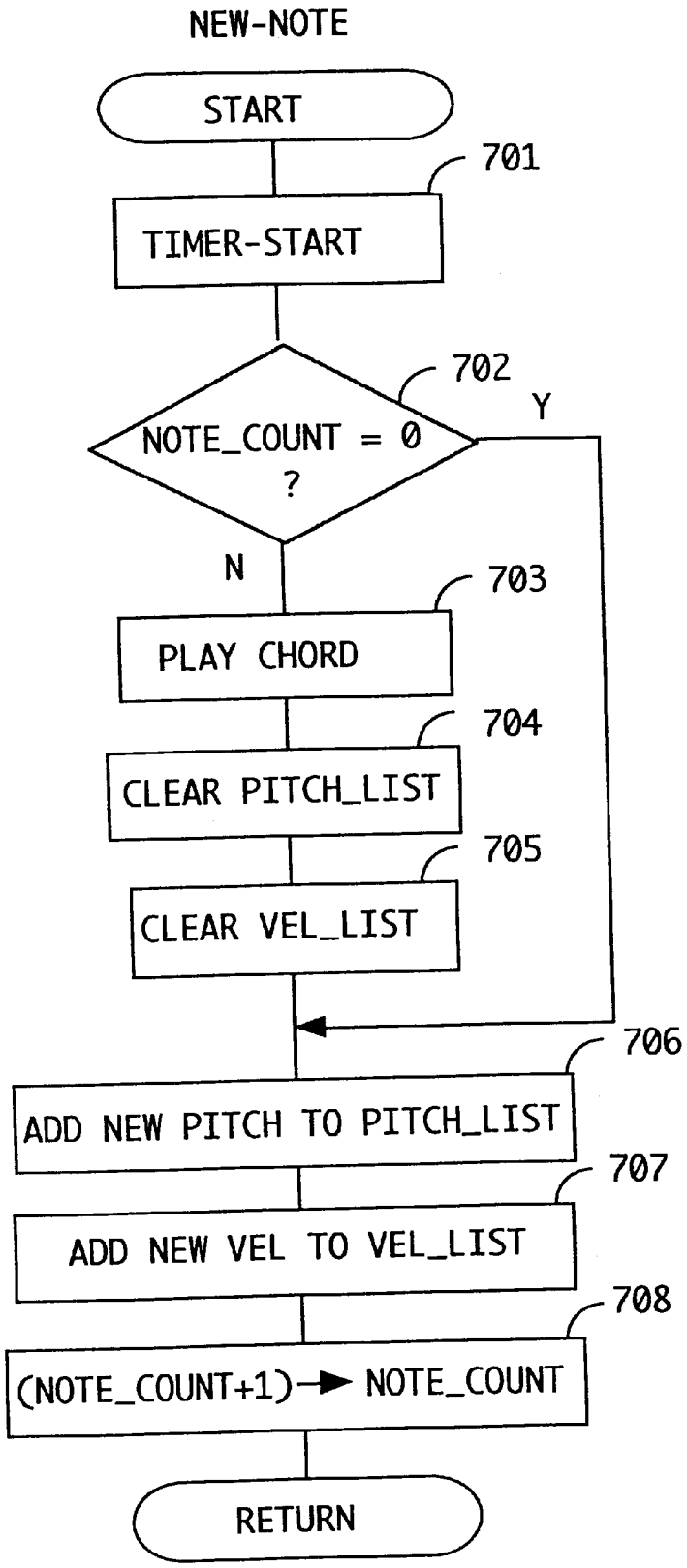
FIG. 17 is a procedural flowchart of an alternative implementation of the new note routine illustrated in FIG. 7.

In the preferred embodiment, chord notes are grouped together and processed as a list at step 56 of FIG. 9. The present invention is not limited to this, and every chord note can be processed singly as it is detected. This is achieved by replacing the new note routine shown in FIG. 7 with the alternative implementation shown in FIG. 17. In step 701, the timer measuring interval T1 is started by executing the timer start routine shown in FIG. 14A. In step 702, the value of NOTE_COUNT is tested. If NOTE_COUNT is zero, processing continues at step 706. If NOTE_COUNT is not zero, then a previous note arrived less than interval T1 ago, and PITCH_LIST and VEL_LIST contain the data for it. In step 703, the previous note is played by executing the play chord routine shown in FIG. 10. In step 704, all values are removed from the variable PITCH_LIST. In step 705, all values are removed from the variable VEL_LIST. In step 706, the pitch of the note-on event is extracted and added to the list of pitches PITCH_LIST. In step 707, the velocity of the note-on event is extracted and added to the list of velocities VEL_LIST. In step 708, the variable NOTE_COUNT is incremented. Processing then returns to step 85 of the main loop shown in FIG. 4. In this manner, it can be seen that all notes in a chord excepting the last note are performed by execution of the play chord routine at step 703 FIG. 17. The final note of the chord is performed by execution of the play chord routine in step 56 of FIG. 9.

In the preferred embodiment, the receipt of a new chord causes the notes of the previous chord to stop if they are still sounding. It is also possible to allow the previous chord notes to continue to play. This is achieved by removing steps 101 and 102 in FIG. 10.

In the preferred embodiment, the classify notes routine described in FIG. 9 resets the value of the clock measuring on/on time before the new note or notes are classified. This means that the time interval used to determine whether a note is a melody note or a polyphonic note may begin with the start time of a previous chord note. The present invention is not limited to this, and the classification of melody and polyphonic notes can be determined without respect to chord notes at all. This is achieved by moving step 52 in FIG. 9 so that it is interposed between steps 53 and 63.

In the preferred embodiment, initial durations are calculated by table lookup. There are many other ways to assign durations. For instance, durations can be a function of one or all of: the velocity of the note, the pitch of the note, the on/on time, and the threshold T2. Initial durations can also be set to a constant value.

In the preferred embodiment, the overlap interval between a melody note and its successor note is the product of the on/on time and a constant (see FIG. 11, step 210). The present invention is not limited to this. For example, the overlap interval may be the sum of the on/on time and a constant. More generally, the overlap interval can be any function of the on/on time.

In the preferred embodiment, notes are classified into three types. The current invention is not limited to this. It is possible to classify notes into two types based on the on/on time being less than threshold T1 or not. In this case, the classification is between chords and non-chords. The invention may be configured so that non-chord notes are all treated polyphonically. Alternatively, the invention may be configured so that non-chord notes are all treated melodically.

It is also possible to classify notes into two types based on the on/on time being within the interval [T1, T2 ] or not. In this case, the classification is between melodic and non-melodic notes, and it is musically effective to treat non-melodic notes polyphonically.

In the preferred embodiment, each of the three types of notes is routed to a separate schedule and channel of the tone generator so that the same pitch may be sounding simultaneously on multiple channels with different timbres. The present invention is not limited to this, and it is possible to route all note types to a single schedule transmitting on one channel. In this case, the distinction between chord, melodic, and polyphonic articulation in response to playing style is preserved, but timbre-switching capability is not available.

Having described preferred embodiments of a new and improved method and apparatus for automatic variable articulation and timbre assignment for an electronic musical instrument, it is believed that other modifications, variations and changes will be suggested to those skilled in the art in view of the teachings set forth herein. It is therefore to be understood that all such variations, modifications and changes are believed to fall within the scope of the present invention as defined by the appended claims.

What is claimed is:

1. An electronic musical instrument, comprising:

means for supplying performance data for a first note and for a second note;

a processor for setting durations of said first and second notes in accordance with said performance data, wherein said processor sets an initial duration of said first note without regard to the performance data of said second note, determines a time interval N between a start time of said first note and a start time of said second note, and adjusts the initial duration of the first note as a function of said time interval N when the initial duration of said first note is greater than said time interval N; and a tone generator for generating tones in accordance with the durations of said first and second notes set by said processor.

2. The electronic musical instrument according to claim 1, wherein said processor adjusts the initial duration of said first note to a duration substantially equal to the time interval N if the time interval N is less than the initial duration of said first note.

3. The electronic musical instrument according to claim 1, wherein, if the time interval N is less than the initial duration of said first note, said processor adjusts the initial duration of said first note such that a time of overlap between said first note and said second note is a function of the time interval N.

4. The electronic musical instrument according to claim 1, wherein said performance data includes velocity data indicating a force with which each note is played and a pitch of each note, wherein said processor sets the initial duration of said first note as a function of at least one of: the velocity data corresponding to said first note; the pitch of said first note; a time interval N−1 between the start time of said first note and the start time of a previous note; and a predetermined duration.

5. The electronic musical instrument according to claim 1, further comprising a selector for selecting one of a first melodic mode and a second melodic mode, wherein:

when the first melodic mode is selected, if the time interval N is less than the initial duration of said first note, said processor adjusts the initial duration of said first note such that a time of overlap between said first note and said second note is a function of the time interval N; and when the second melodic mode is selected, said processor adjusts the initial duration of said first note to a duration substantially equal to the time interval N if the time interval N is less than the initial duration of said first note.

6. The electronic musical instrument according to claim 1, wherein said means for supplying performance data is at least one of: a music controller; a playable controller interface; and a data transmission line.

7. The electronic musical instrument according to claim 6, wherein said music controller is at least one of: a keyboard, a xylophone-type keyboard, an array of drum pads and a keyed wind instrument.

8. The electronic musical instrument according to claim 1, wherein said tone generator is a polyphonic tone generator.

9. The electronic musical instrument according to claim 1, wherein said tone generator is a multi-channel, multi-timbral tone generator.

10. An apparatus for controlling an articulation between successive musical notes, comprising:

a note classifier for classifying at least a first note in accordance with performance data relating thereto, wherein said note classifier determines a time interval N−1 between a start time of said first note and a start time of an immediately previous note and determines a time interval N between the start time of said first note and a start time of an immediately subsequent note, classifies said first note and said immediately previous note as chord notes when the time interval N−1 is less than a first threshold time, classifies said first note as a polyphonic note when the time interval N−1 is greater than a second threshold time, and classifies said first note as a melodic note when the time interval N−1 is between said first and second threshold times; and a processor for setting a duration of at least said first note in accordance with a classification of said first note by said note classifier, such that: when said first note and said immediately previous note are classified as chord notes, durations of said first note and said immediately previous note are substantially overlapped; when said first note is classified as a polyphonic note, said processor sets a duration of said first note; and, when said first note is classified as a melodic note, said processor sets an initial duration of said first note and adjusts the initial duration of the first note as a function of said time interval N if the initial duration of said first note is greater than said time interval N.

11. The apparatus according to claim 10, wherein said processor sets the initial duration of said first note as a function of at least one of: a velocity at which said first note is played; a pitch of said first note; the time interval N−1; and the second threshold time.

12. The apparatus according to claim 10, further comprising a selector for selecting one of a first melodic mode and a second melodic mode, wherein:

when the first melodic mode is selected and said first note is classified as a melodic note, if the time interval N is less than the initial duration of said first note, said processor adjusts the initial duration of said first note such that a time of overlap between said first note and said immediately subsequent note is a function of the time interval N; and when the second melodic mode is selected and said first note is classified as a melodic note, if the time interval N is less than the initial duration of said first note, said processor adjusts the initial duration of said first note to a duration substantially equal to the time interval N.

13. The apparatus according to claim 12, further comprising a tone generator for generating tones in accordance with the duration of said first note, wherein:

when the first melodic mode is selected and said first note is classified as a melodic note, said tone generator generates at most two tones at a time; and when the second melodic mode is selected and said first note is classified as a melodic note, said tone generator generates only a single tone at a time.

14. The apparatus according to claim 10, wherein, when said first note is classified as a melodic note, if the time interval N is less than the initial duration of said first note, said processor adjusts the initial duration of said first note such that a time of overlap between said first note and said immediately subsequent note is a function of the time interval N.

15. The apparatus according to claim 10, wherein, when said first note is classified as a melodic note, if the time interval N is less than the initial duration of said first note, said processor adjusts the initial duration of said first note to a duration substantially equal to the time interval N.

16. The apparatus according to claim 10, wherein, when said first note and said immediately previous note are classified as chord notes, said processor sets a common start time and a common duration for said first note and said immediately previous note.

17. The apparatus according to claim 10, wherein said processor includes a first output channel, a second output channel, and a third output channel, wherein chord notes are assigned to said first output channel, melodic notes are assigned to said second output channel, and polyphonic notes are assigned to said third output channel.

18. An apparatus for controlling an articulation between successive musical notes, comprising:

means for supplying performance data for a first note and for a second note; and a processor responsive to said performance data for determining a time interval N between a start time of said first note and a start time of said second note and setting a duration of said first note such that a time of overlap between said first note and said second note is a function of the time interval N.

19. An apparatus for controlling an articulation between successive musical notes, comprising:

means for supplying performance data for a first note, a second note and a third note; and a processor responsive to said performance data for determining a time interval N−1 between a start time of said first note and a start time of said second note, setting an initial duration of said second note to a duration less than the time interval N=1, determining a time interval N between a start time of said second note and a start time of said third note, and, if the time interval N is less than the initial duration of said second note, adjusting the initial duration of said second note to a duration substantially equal to the time interval N.

20. An apparatus for generating a chord of pitches, comprising:

means for supplying performance data corresponding to individual notes, the performance data including a note-on time and pitch data for each note;

a processor responsive to the performance data of a sequence of at least two notes, for setting a common start time and a common duration for every note in the sequence when, for each note in the sequence, a duration between the note-on time of a note and the note-on time of an immediately subsequent note is less than a predetermined time interval; and a tone generator for simultaneously generating a plurality of tones at said common start time for said common duration, said tones having pitches that correspond to the pitch data of said sequences of at least two notes.

21. A method for controlling an articulation between successive musical notes, comprising the steps of:

receiving performance data for a first note and for a second note;

setting an initial duration of said first note without regard to the performance data of said second note;

determining a time interval N between a start time of said first note and a start time of said second note based on said performance data;

adjusting the initial duration of the first note as a function of said time interval N when the initial duration of said first note is greater than said time interval N; and generating tones in accordance with durations of said first and second notes.

22. The method according to claim 21, wherein, if the time interval N is less than the initial duration of said first note, said adjusting step includes adjusting the initial duration of said first note to a duration substantially equal to the time interval N.

23. The method according to claim 21, wherein, if the time interval N is less than the initial duration of said first note, said adjusting step includes adjusting the initial duration of said first note such that a time of overlap between said first note and said second note is a function of the time interval N.

24. The method according to claim 21, wherein said performance data includes velocity data indicating a force with which each note is played and a pitch of each note, wherein said setting step includes setting the initial duration of said first note as a function of at least one of: the velocity data corresponding to said first note; the pitch of said first note; a time interval N−1 between the start time of the first note and the start time of a previous note; and a predetermined duration.

25. The method according to claim 21, further comprising the step of selecting one of a first melodic mode and a second melodic mode, wherein:

when the first melodic mode is selected, if the time interval N is less than the initial duration of said first note, said adjusting steps includes adjusting the initial duration of said first note such that a time of overlap between said first note and said second note is a function of the time interval N; and when the second melodic mode is selected, if the time interval N is less than the initial duration of said first note, said adjusting step includes adjusting the initial duration of said first note to a duration substantially equal to the time interval N.

26. A method for controlling an articulation between successive musical notes, comprising the steps of:

determining a time interval N−1 between a start time of a first note and a start time of an immediately previous note based on performance data relating thereto;

determining a time interval N between a start time of said first note and a start time of an immediately subsequent note based on performance data relating thereto;

classifying said first note and said immediately previous note as chord notes when the time interval N−1 is less than a first threshold time;

classifying said first note as a polyphonic note when the time interval N−1 is greater than a second threshold time;

classifying said first note as a melodic note when the time interval N−1 is between said first and second threshold times;

when said first note and said immediately previous note are classified as chord notes, substantially overlapping durations of said first note and said immediately previous note;

when said first note is classified as a polyphonic note, setting a duration of said first note; and when said first note is classified as a melodic note, setting an initial duration of said first note and adjusting the initial duration of the first note as a function of said time interval N if the initial duration of said first note is greater than said time interval N.

27. The method according to claim 26, wherein the initial duration of said first note is set as a function of at least one of: a velocity at which said first note is played; a pitch of said first note; the time interval N−1; and the second threshold time.

28. The method according to claim 26, further comprising the steps of:

selecting one of a first melodic mode and a second melodic mode;

when the first melodic mode is selected and said first note is classified as a melodic note, if the time interval N is less than the initial duration of said first note, adjusting the initial duration of said first note such that a time of overlap between said first note and said immediately subsequent is a function of the time interval N; and when the second melodic mode is selected and said first note is classified as a melodic note, if the time interval N is less than the initial duration of said first note, adjusting the initial duration of said first note to a duration substantially equal to the time interval N.

29. The method according to claim 28, further comprising the step of:

generating tones in accordance with the durations of said first and second notes, wherein: when the first melodic mode is selected and said first note is classified as a melodic note, at most two tones are generated at a time; and, when the second melodic mode is selected and said first note is classified as a melodic note, only a single tone is generated at a time.

30. The method according to claim 26, further comprising the step of adjusting the initial duration of said first note such that a time of overlap between said first note and said immediately subsequent note is a function of the time interval N if the time interval N is less than the initial duration of said first note and said first note is classified as a melodic note.

31. The method according to claim 26, further comprising the step of adjusting the initial duration of said first note to a duration substantially equal to the time interval N if the time interval N is less than the initial duration of said first note and said first note is classified as a melodic note.

32. The method according to claim 26, further comprising the step of setting a common start time and a common duration for said first note and said immediately previous note when said first note and said immediately previous note are classified as chord notes.

33. The method according to claim 26, further comprising the steps of:

assigning chord notes to a first channel;

assigning polyphonic notes to second channel; and assigning melodic notes to a third channel.

34. A method for controlling an articulation between successive musical notes, comprising the steps of:

receiving performance data for a first note and for a second note;

determining a time interval N between a start time of said first note and a start time of said second note based on said performance data;

setting a duration of said first note such that a time of overlap between said first note and said second note is a function of the time interval N.

35. A method for controlling an articulation between successive musical notes, comprising the steps of:

receiving performance data for a first note a second note, and a third note;

determining a time interval N−1 between a start time of said first note and a start time of said second note based on said performance data;

setting an initial duration of said second note to a duration less than the time interval N−1;

determining a time interval N between a start time of said second note and a start time of said third note based on said performance data;

adjusting the initial duration of said second to a duration substantially equal to the time interval N if the time interval N is less than the initial duration of said second note.

36. A method for generating a chord of pitches, comprising the steps of:

receiving performance data corresponding to individual notes, the performance data including a note-on time and pitch data for each note;

detecting a note-on time of a first note;

collecting the performance data for subsequent notes whose respective note-on times are within a predetermined time interval of the note-on time of said first note;

setting a common start time and a common duration for said first note and said subsequent notes; and simultaneously generating a plurality of tones at said same start time for said same duration, said tones having pitches that correspond to the pitch data of said first note and said subsequent notes.

* * * * *